US008280265B2

(12) United States Patent
Haruyama

(10) Patent No.: US 8,280,265 B2
(45) Date of Patent: Oct. 2, 2012

(54) IMAGE FORMING APPARATUS WITH DRIVE CONTROL UNIT

(75) Inventor: Masahiro Haruyama, Tokyo (JP)

(73) Assignee: Oki Data Corporation, Tokyo (JP)

( * ) Notice: Subject to any disclaimer, the term of this patent is extended or adjusted under 35 U.S.C. 154(b) by 494 days.

(21) Appl. No.: 12/385,462

(22) Filed: Apr. 9, 2009

(65) Prior Publication Data

US 2009/0297176 A1 Dec. 3, 2009

(30) Foreign Application Priority Data

May 30, 2008 (JP) ..... 2008-143519

(51) Int. Cl.
*G03G 15/08* (2006.01)

(52) U.S. Cl. ..... 399/29; 399/257

(58) Field of Classification Search ..... 399/27, 399/29, 257
See application file for complete search history.

(56) References Cited

U.S. PATENT DOCUMENTS

2003/0123907 A1* 7/2003 Nonaka et al. ..... 399/257
2009/0003865 A1* 1/2009 Endou et al.

FOREIGN PATENT DOCUMENTS

JP 2004-045481 2/2004

* cited by examiner

*Primary Examiner* — David Gray
*Assistant Examiner* — Laura Roth
(74) *Attorney, Agent, or Firm* — Kubotera & Associates, LLC

(57) ABSTRACT

An image forming apparatus is provided with a developing unit for attaching developer to a static latent image formed through charging and exposing to form a developer image; an image supporting member for supporting the developer image formed with the developing unit; a removing member disposed to abut against the image supporting member for removing developer; a drive unit for driving the image supporting member; a drive control unit for controlling the drive unit; and a fixing unit for fixing the developer image to a medium. It is configured such that the drive control unit controls the drive unit to temporarily stop before developer is discharged.

19 Claims, 15 Drawing Sheets

IMAGE FORMING APPARATUS WITH DRIVE CONTROL UNIT

BACKGROUND OF THE INVENTION AND RELATED ART STATEMENT

The present invention relates to an image forming apparatus.

A conventional image forming apparatus of an electrophotography type such as a printer, a copier, a facsimile, a multi-function product, and the likes is provided with a photosensitive drum; a charging roller for charging the photosensitive drum with a specific polarity or potential; an exposure device for forming a static latent image on the photosensitive drum thus charged; a developing roller for developing the static latent image to form a toner image; a transfer roller for transferring the toner image to a sheet; and a fixing device for fixing the toner image to the sheet.

In the conventional image forming apparatus, a physical force is applied to toner as developer to form a uniform layer thereof on the developing roller. Further, after toner remains on the photosensitive drum without moving to the sheet upon transferring the toner image, the charging roller applies a physical force to toner. In such a case, frictional heat is generated, and toner may be crashed or agglomerated due to the frictional heat, thereby deteriorating toner.

When toner is deteriorated, toner thus deteriorated tends to accumulate in the developing device as a printing operation proceeds. Accordingly, there have been problems such as a variance in an image density, low reproducibility of dots constituting an image, and a blurred image. To this end, it is configured such that toner thus deteriorated inside the developing device is discharged to the photosensitive drum, so that a cleaning blade abutting against the photosensitive drum scrapes off toner, thereby collecting toner in a waste toner box (refer to Patent Reference).

Patent Reference: Japanese Patent Publication No. 2004-045481

In the conventional integrated image forming unit described above, when a plurality of sheets is printed continuously in a continuous printing operation and toner is discharged, it is difficult to sufficiently scrape off toner thus discharged with the cleaning blade, thereby causing a problem in cleaning.

In view of the problems described above, an object of the present invention is to provide an image reading apparatus capable of solving the problems of the conventional image forming apparatus. In the image forming apparatus of the present invention, even when a plurality of sheets is printed continuously in a continuous printing operation, it is possible to sufficiently scrape off toner discharged. Accordingly, it is possible to prevent a problem in cleaning.

Further objects and advantages of the invention will be apparent from the following description of the invention.

SUMMARY OF THE INVENTION

In order to attain the objects described above, according to an aspect of the present invention, an image forming apparatus is provided with a developing unit for attaching developer to a static latent image formed through charging and exposing to form a developer image; an image supporting member for supporting the developer image formed with the developing unit; a removing member disposed to abut against the image supporting member for removing developer; a drive unit for driving the image supporting member; a drive control unit for controlling the drive unit; and a fixing unit for fixing the developer image to a medium. It is configured such that the drive control unit controls the drive unit to temporarily stop before developer is discharged.

In the aspect of the present invention, the image forming apparatus is provided with the developing unit for attaching developer to the static latent image formed through charging and exposing to form the developer image; the image supporting member for supporting the developer image formed with the developing unit; the removing member disposed to abut against the image supporting member for removing developer; the drive unit for driving the image supporting member; the drive control unit for controlling the drive unit; and the fixing unit for fixing the developer image to a medium. It is configured such that the drive control unit controls the drive unit to temporarily stop before developer is discharged.

When it is determined that developer is deteriorated, developer is discharged after the drive unit driving the image supporting member temporarily stops. Accordingly, when a foreign object is accumulated at an abutting portion between the image supporting member and the removing member during a continuous printing operation, the foreign object is removed from the abutting portion. As a result, it is possible to scrape off developer thus discharged, thereby preventing a problem in cleaning.

DETAILED DESCRIPTION OF THE PREFERRED EMBODIMENTS

Hereunder, embodiments of the present invention will be explained with reference to the accompanying drawings. In the following description, a printer will be explained as an image forming apparatus.

First Embodiment

Figure 1:
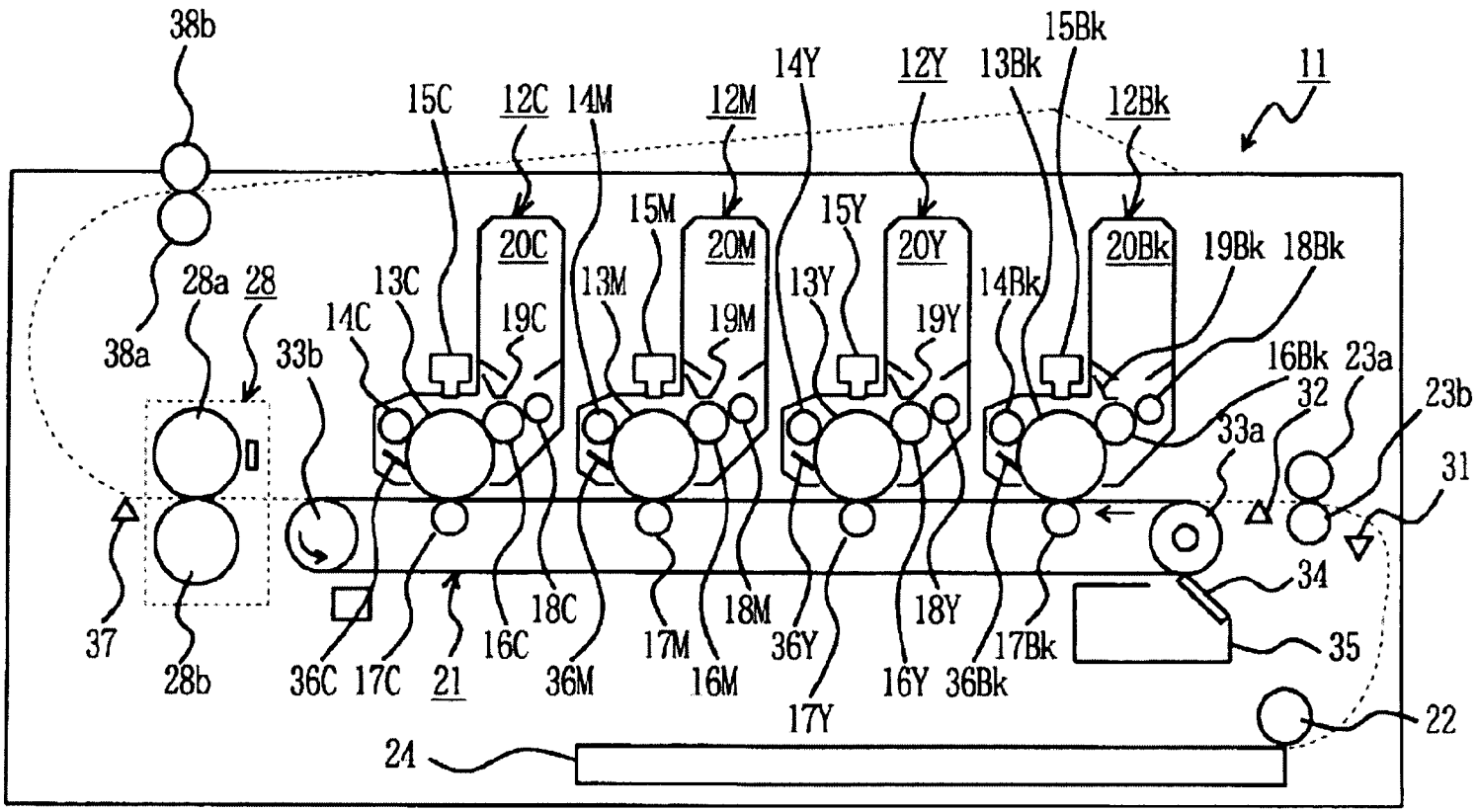
FIG. 1 is a schematic sectional view showing a printer according to a first embodiment of the present invention.

A first embodiment of the present invention will be explained. FIG. 1 is a schematic sectional view showing a printer 11 according to the first embodiment of the present invention.

As shown in FIG. 1, the printer 11 includes image forming units 12Bk, 12Y, 12M, and 12C constituting four separate image forming portions. The image forming units 12Bk, 12Y, 12M, and 12C are arranged from an upstream side to a downstream side in a direction that a medium (not shown) is transported for forming images in colors of black, yellow, cyan, and magenta. The medium includes an OHP sheet, an envelope, a copy paper, and a special paper in addition to a sheet.

In the embodiment, the image forming units 12Bk, 12Y, 12M, and 12C respectively include photosensitive drums 13Bk, 13Y, 13M, and 13C as image supporting members or photosensitive members; charging rollers 14Bk, 14Y, 14M, and 14C as charging devices for uniformly charging surfaces of the photosensitive drums 13Bk, 13Y, 13M, and 13C; and developing rollers 16Bk, 16Y, 16M, and 16C as developer supporting members for attaching toner or developer to static latent images formed on the surfaces of the photosensitive drums 13Bk, 13Y, 13M, and 13C to form toner images or developer images as visual images in colors.

In the embodiment, developer supply rollers 18Bk, 18Y, 18M, and 18C are arranged as developer supply members to abut against the developing rollers 16Bk, 16Y, 16M, and 16C, respectively. The developer supply rollers 18Bk, 18Y, 18M, and 18C supply toner supplied from toner cartridges 20Bk, 20Y, 20M, and 20C as developer cartridges to the developing rollers 16Bk, 16Y, 16M, and 16C. Developing blades 19Bk, 19Y, 19M, and 19C are arranged as developer supply members to abut against the developing rollers 16Bk, 16Y, 16M, and 16C, respectively. The developing blades 19Bk, 19Y, 19M, and 19C are provided for forming thin layers of toner supplied from the developer supply rollers 18Bk, 18Y, 18M, and 18C on the developing rollers 16Bk, 16Y, 16M, and 16C, respectively.

In the embodiment, cleaning blades 36Bk, 36Y, 36M, and 36C are arranged as first cleaning members or first removing members to abut against the photosensitive drums 13Bk, 13Y, 13M, and 13C, respectively. The cleaning blades 36Bk, 36Y, 36M, and 36C are formed of elastic members, and are provided for cleaning the surfaces of the photosensitive drums 13Bk, 13Y, 13M, and 13C. More specifically, after transferring the toner images to the sheet, the cleaning blades 36Bk, 36Y, 36M, and 36C scrape off toner remaining on the photosensitive drums 13Bk, 13Y, 13M, and 13C, thereby removing toner. In this case, the photosensitive drums 13Bk, 13Y, 13M, and 13C correspond to objects to be cleaned.

In the embodiment, the developing rollers 16Bk, 16Y, 16M, and 16C; the toner supply rollers 18Bk, 18Y, 18M, and 18C; the developing blades 19Bk, 19Y, 19M, and 19C; and the toner cartridges 20Bk, 20Y, 20M, and 20C constitute developing units of the image forming units 12Bk, 12Y, 12M, and 12C, respectively.

In the image forming units 12Bk, 12Y, 12M, and 12C, LED heads 15Bk, 15Y, 15M, and 15C are disposed as exposure devices above the photosensitive drums 13Bk, 13Y, 13M, and 13C to face the photosensitive drums 13Bk, 13Y, 13M, and 13C, respectively. The LED heads 15Bk, 15Y, 15M, and 15C are provided for exposing the photosensitive drums 13Bk, 13Y, 13M, and 13C respectively to form static latent images thereon.

In the image forming units 12Bk, 12Y, 12M, and 12C, a transfer unit is disposed below the photosensitive drums 13Bk, 13Y, 13M, and 13C. The transfer unit includes a transport belt 21 as a first transfer member with an endless shape; a transport belt follower roller 33*a* and a transport belt drive roller 33*b* supported with a spring (not shown) to be rotatable along with a movement of the transport belt 21 for extending the transport belt 12 with a constant tension; and transfer rollers 17Bk, 17Y, 17M, and 17C disposed as second transfer members to face the photosensitive drums 13Bk, 13Y, 13M, and 13C through the transport belt 21 for charging the sheet with a polarity opposite to that of toner, so that the toner images in colors are transferred to the sheet.

In the embodiment, a transport belt blade 34 as a second cleaning member or a second removing member is disposed to abut against the transport belt 21 for scraping off toner attached to the transport belt 21 and cleaning the surface of the transport belt 21. The transport belt blade 34 is formed of an elastic material such as a urethane rubber. Further, a transport belt waste toner box 35 as a first developer container is disposed below the transport belt blade 34 for collecting toner removed with the transport belt blade 34. In this case, the transport belt 21 corresponds to an object to be cleaned.

In the embodiment, a sheet supply mechanism is disposed at a lower portion of the printer 11 for transporting the sheet to a transport path. The sheet supply mechanism includes a sheet storage cassette 24 as a medium storage unit; a sheet supply roller 22 for separating and feeding the sheet from the sheet storage cassette 24 one by one using a separation tongue member and the likes; an inlet sensor 31; register rollers 23*a* and 23*b*; a writing sensor 32; and the likes. The sheet supply roller 22 feeds the sheet retained in the sheet storage cassette 24 to the register rollers 23*a* and 23*b*.

After the sheet supply roller 22 feeds the sheet to the register rollers 23*a* and 23*b*, the sheet is transported to the transport belt 21. As the transport belt 21 moves to transport the sheet, the transfer rollers 17Bk, 17Y, 17M, and 17C transfer the toner images in colors to the sheet, thereby forming a color toner image.

After the color toner image is formed, the sheet is transported to a fixing device 28 as a fixing unit. The fixing device 28 includes a heating roller 28*a* and a pressing roller 28*b* for heating and pressing the sheet, thereby fixing the color toner image to the sheet. A heating member (not shown) such as a halogen lamp is disposed in the heating roller 28*a* and the pressing roller 28*b*.

In the embodiment, the printer 11 includes a discharge sensor 37 and discharge rollers 38*a* and 38*b*. Further, the printer 11 includes rollers (not shown) arranged along the transport path with an interval smaller than a sheet with a smallest size, a motor for driving the rollers, and a solenoid for switching the transport path.

Figure 2:
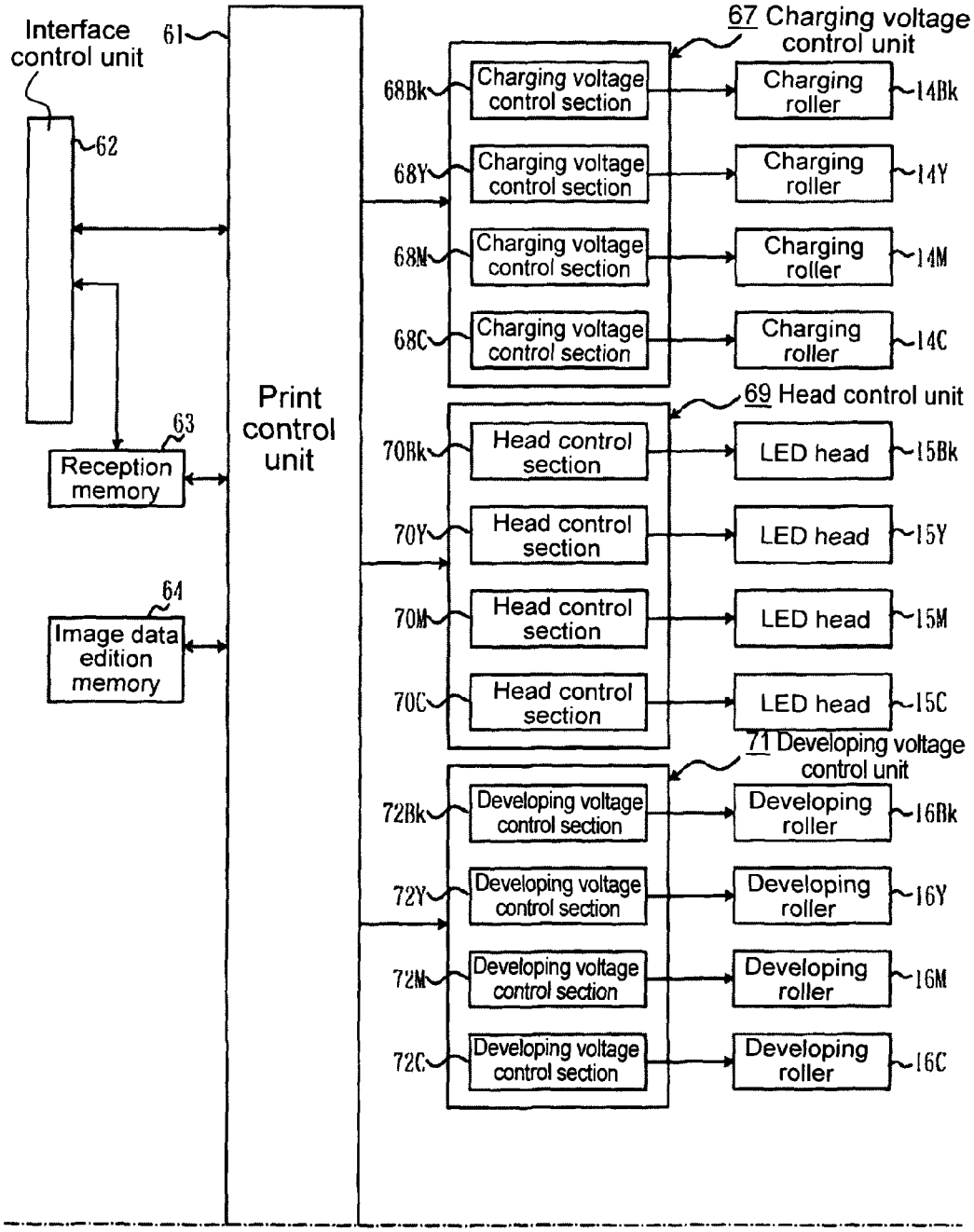
FIG. 2 is a block diagram No. 1 showing a control system of the printer according to the first embodiment of the present invention.
Figure 3:
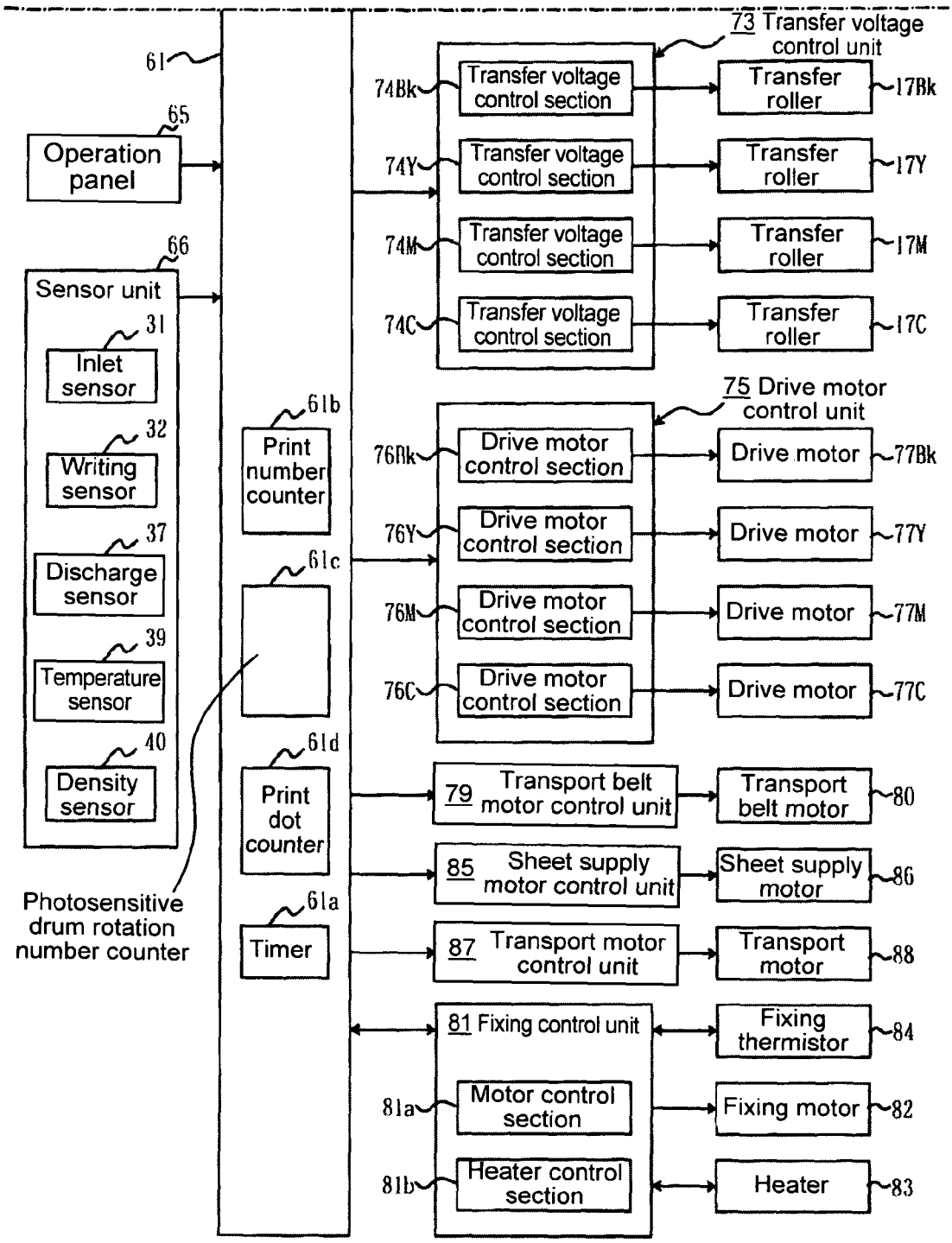
FIG. 3 is a block diagram No. 2 showing the control system of the printer according to the first embodiment of the present invention.

A control system of the printer 11 will be explained next. FIG. 2 is a block diagram No. 1 showing the control system of the printer 11 according to the first embodiment of the present invention. FIG. 3 is a block diagram No. 2 showing the control system of the printer 11 according to the first embodiment of the present invention. Note that the control system of the printer 11 is divided into two portions shown in FIGS. 2 and 3, respectively.

As shown in FIGS. 2 and 3, the control system includes a print control unit 61. The print control unit 61 is formed of a microprocessor (not shown); an ROM; an RAM; an input/output port; a timer 61*a*; a print number counter 61*b* as a first counter for counting a print number; a photosensitive drum rotation number counter 61*c* as a second counter for counting a rotation number of the photosensitive drums 13Bk, 13Y, 13M, and 13C; a print dot counter 61*d* as a third counter for counting a print dot; and the likes.

In the embodiment, the print control unit 61 controls an entire printing operation of the printer 11 for printing and forming a color image according to print data and a control command received from a host computer as a host device (not shown) through an interface control unit 62. The interface control unit 62 sends information indicating a state of the printer 11 to the host computer, and analyzes the control command received from the host computer to store the print data per color into a reception memory 63.

In the embodiment, the print control unit 61 edits the print data received from the host computer through the interface control unit 62, so that the print data are stored in an image data edition memory 64 as image data for each color to be sent to the LED heads 15Bk, 15Y, 15M, and 15C. The image data edition memory 64 receives the print data temporarily stored in the reception memory 63, and stores the image data thus edited to be sent to the LED heads 15Bk, 15Y, 15M, and 15C.

In the embodiment, the control system further includes an operation panel 65 as an operation unit. The operation panel 65 includes an LED (not shown) for displaying a state of the printer 11 and a switch (not shown) for inputting an instruction of an operator to the printer 11. Further, the control system includes a sensor unit 66 formed of a plurality of sensors (the inlet sensor 31, the writing sensor 32, the discharge sensor 37) for determining a position of the sheet in the transport path; a temperature sensor 39 as an environment parameter detection unit or a temperature detection unit for detecting an environment parameter where the printer 11 is placed, i.e., an internal temperature or an environment temperature of the printer 11; and a density sensor 40 for detecting a density of a color image. The sensor unit 66 sends an output of each sensor to the print control unit 61.

In the embodiment, the print control unit 61 is connected to a charging voltage control unit 67; a head control unit 69; a developing voltage control unit 71; a transfer voltage control unit 73; a drive motor control unit 75 as a first drive control unit; a transport belt motor control unit 79 as a second drive control unit; a fixing control unit 81; a sheet supply motor control unit 85; and a transport motor control unit 87.

In the embodiment, upon receiving an instruction from the print control unit 61, the charging voltage control unit 67 applies a charging voltage to each of the charging rollers 14Bk, 14Y, 14M, and 14C for charging the surfaces of the photosensitive drums 13Bk, 13Y, 13M, and 13C. Further, the charging voltage control unit 67 includes charging voltage control sections 68Bk, 68Y, 68M, and 68C for controlling the charging voltage applied to each of the charging rollers 14Bk, 14Y, 14M, and 14C, thereby adjusting colors.

In the embodiment, upon receiving an instruction from the print control unit 61, the head control unit 69 receives the image data in each color stored in the image data edition memory 64, and sends the image data to the LED heads 15Bk, 15Y, 15M, and 15C. Accordingly, LED elements of LED arrays (not show) selectively emit light and irradiate the surfaces of the photosensitive drums 13Bk, 13Y, 13M, and 13C, thereby forming the static latent images on the photosensitive drums 13Bk, 13Y, 13M, and 13C. Further, the head control unit 69 includes heads control sections 70Bk, 70Y, 70M, and 70C for controlling colors and sending the image data to the LED heads 15Bk, 15Y, 15M, and 15C at specific timings.

In the embodiment, upon receiving an instruction from the print control unit 61, the developing voltage control unit 71 applies a developing voltage to each of the developing rollers 16Bk, 16Y, 16M, and 16C. Accordingly, toner is attached to the static latent images formed on the photosensitive drums 13Bk, 13Y, 13M, and 13C, thereby forming the toner images on the photosensitive drums 13Bk, 13Y, 13M, and 13C. Further, the developing voltage control unit 71 includes developing voltage control sections 72Bk, 72Y, 72M, and 72C for controlling colors and the developing voltage applied to each of the developing rollers 16Bk, 16Y, 16M, and 16C. Accordingly, the toner images are formed in areas on the photosensitive drums 13Bk, 13Y, 13M, and 13C where the LED heads 15Bk, 15Y, 15M, and 15C expose.

In the embodiment, upon receiving an instruction from the print control unit 61, the transfer voltage control unit 73 applies a transfer voltage to each of the transfer rollers 17Bk, 17Y, 17M, and 17C. Accordingly, the toner images formed on the photosensitive drums 13Bk, 13Y, 13M, and 13C are transferred to the sheet. Further, the transfer voltage control unit 73 includes transfer voltage control sections 74Bk, 74Y, 74M, and 74C for sequentially transferring each of the toner images to the sheet.

In the embodiment, upon receiving an instruction from the print control unit 61, the drive motor control unit 75 drives drive motors 77Bk, 77Y, 77M, and 77C as drive sources for rotating the photosensitive drums 13Bk, 13Y, 13M, and 13C, the charging rollers 14Bk, 14Y, 14M, and 14C, and the developing rollers 16Bk, 16Y, 16M, and 16C, respectively. Further, the drive motor control unit 75 includes drive motor control sections 76Bk, 76Y, 76M, and 76C for controlling colors.

In the embodiment, upon receiving an instruction from the print control unit 61, the sheet supply motor control unit 85 drives a sheet supply motor 86 as a sheet supply drive source for rotating the sheet supply roller 22. Upon receiving an instruction from the print control unit 61, the transport motor control unit 87 drives a transport motor 88 as a sheet transport drive source for rotating the register rollers 23*a* and 23*b*. Upon receiving an instruction from the print control unit 61, the transport belt motor control unit 79 drives a transport belt motor 80 as a transport drive source of the transport belt 21 for rotating the transport belt drive roller 33*b* to move the transport belt 21.

In the embodiment, upon receiving an instruction from the print control unit 61, the fixing control unit 81 applies a fixing voltage to a heater 83 disposed in the fixing device 28, thereby fixing the toner images thus transferred to the sheet. Further, the fixing control unit 81 includes a heater control section 81*b* for switching the heater 83 according to a temperature detected with a fixing thermistor 84, and a motor control section 81*a* for driving a fixing motor 82 as a fixing drive source to rotate the heating roller 28*a* and the pressing roller 28*b* when the fixing device 28 reaches a specific temperature.

An operation of the printer 11 will be explained next. When the print control unit 61 receives a print instruction upon receiving the control command and the print data from the host computer through the interface control unit 62, the print control unit 61 sends a specific transport speed to the sheet supply motor control unit 85 and the transport motor control unit 87 to drive the sheet supply motor 86 and the transport motor 88, respectively. Accordingly, the sheet supply roller 22 rotates and picks up the sheet from the sheet storage cassette 24 one by one, and transports the sheet to the register rollers 23*a* and 23*b*. It is determined whether the sheet supply roller 22 transports the sheet normally according to a detection result of the inlet sensor 31. When it is determined that the sheet supply roller 22 does not transport the sheet normally, the sheet supply roller 22 picks up the sheet one more time.

After the sheet is transported to the register rollers 23*a* and 23*b*, the register rollers 23*a* and 23*b* rotate to transport the sheet to the image forming unit 12K. It is configured such that the rollers start rotating substantially at the same time in the image forming units 12Bk, 12Y, 12M, and 12C. When the print control unit 61 sends an instruction to the charging voltage control unit 67 to apply a specific voltage, for example, a negative voltage of about −1,000 V, the charging voltage control unit 67 applies the specific voltage to the charging rollers 14Bk, 14Y, 14M, and 14C, thereby uniformly charging the surfaces of the photosensitive drums 13Bk, 13Y, 13M, and 13C.

In the next step, toner to be used for the printing operation is supplied from the toner cartridges 20Bk, 20Y, 20M, and 20C to the developer supply rollers 18Bk, 18Y, 18M, and 18C, and then is supplied to the developing rollers 16Bk, 16Y, 16M, and 16C through the developer supply rollers 18Bk, 18Y, 18M, and 18C, respectively. After toner is supplied to the developing rollers 16Bk, 16Y, 16M, and 16C, the developing blades 19Bk, 19Y, 19M, and 19C charge (frictional charging) toner.

When the photosensitive drums 13Bk, 13Y, 13M, and 13C rotate, the transport belt drive roller 33*b* rotates to move the transport belt 21. Note that the photosensitive drums 13Bk, 13Y, 13M, and 13C rotate at a circumferential speed the same as a moving speed of the transport belt 21.

While the sheet is transported from the register rollers 23*a* and 23*b* to the image forming unit 12Bk, the writing sensor 32 is turned on upon detecting a leading edge of the sheet. After a specific period of time, the print control unit 61 sends an instruction to the head control unit 69 for exposure, so that the head control unit 69 drives the LED heads 15Bk, 15Y, 15M, and 15C. When the LED heads 15Bk, 15Y, 15M, and 15C irradiate, the static latent images are formed on the surfaces of the photosensitive drums 13Bk, 13Y, 13M, and 13C.

In the next step, when the photosensitive drums 13Bk, 13Y, 13M, and 13C rotate, and the static latent images reach positions facing the developing rollers 16Bk, 16Y, 16M, and 16C, the print control unit 61 sends an instruction to the developing voltage control unit 71 to apply a specific voltage, i.e., a negative voltage. Accordingly, the developing voltage control unit 71 applies the negative voltage to the developing rollers 16Bk, 16Y, 16M, and 16C, so that toner on the developing rollers 16Bk, 16Y, 16M, and 16C is attached to the photosensitive drums 13Bk, 13Y, 13M, and 13C, thereby developing the static latent images to form the toner images.

In the next step, while the transport belt 21 is moving, when the sheet reaches a position between the photosensitive drums 13Bk, 13Y, 13M, and 13C and the transfer rollers 17Bk, 17Y, 17M, and 17C, and the toner images formed on the photosensitive drums 13Bk, 13Y, 13M, and 13C reach positions facing the transport belt 21, the print control unit 61 sends an instruction to the transfer voltage control unit 73 to apply a specific voltage, i.e., a positive voltage of about +3,000 V. Accordingly, the transfer voltage control unit 73 applies the positive voltage to the transfer rollers 17Bk, 17Y, 17M, and 17C, thereby transferring the toner images to the sheet.

After the toner images are transferred to the sheet, the cleaning blades 36Bk, 36Y, 36M, and 36C scrape off toner remaining on the photosensitive drums 13Bk, 13Y, 13M, and 13C, thereby collecting toner. After the toner images in each color are sequentially transferred to the sheet, the color toner image is formed on the sheet.

In the next step, the sheet is transported to the fixing device 28, so that the heating roller 28*a* and the pressing roller 28*b* apply pressure and heat to the sheet, thereby fixing the color toner image to the sheet. After the color toner image is fixed to the sheet, when the discharge sensor 37 detects the leading edge of the sheet, the discharge rollers 38*a* and 38*b* discharge the sheet to a stacker (not shown). Through the process described above, the print control unit 61 monitors a sheet jam or measures a size of the sheet after the color toner image is fixed to the sheet according to a sensor output of the discharge sensor 37.

In the printer 11, when a uniform layer of toner is formed on the developing rollers 16Bk, 16Y, 16M, and 16C, a physical force is applied to toner. Further, after toner remains on the photosensitive drums 13Bk, 13Y, 13M, and 13C without moving to the sheet upon transferring the toner images, the charging rollers 14Bk, 14Y, 14M, and 14C apply a physical force to toner. In such a case, frictional heat is generated in toner, and toner may be crashed or agglomerated due to the frictional heat, thereby deteriorating toner.

When toner is deteriorated, toner thus deteriorated tends to accumulate in the developing units as the printing operation proceeds. Accordingly, there have been problems such as a variance in an image density, low reproducibility of dots constituting an image, and a blurred image.

To this end, in the embodiment, it is configured to discharge toner thus deteriorated on to the transport belt 21. In discharging toner thus deteriorated, toner images formed of toner thus deteriorated are transferred to the transport belt 21, not to the sheet, and then the transport belt blade 34 scrapes off toner thus deteriorated, thereby discharging toner thus deteriorated.

An operation of discharging deteriorated toner to the transport belt 21 will be explained next. In the image forming unit 12Bk, when the print control unit 61 sends an instruction to the charging voltage control unit 67 to apply a specific voltage, for example, a negative voltage of about −1,000 V, the charging voltage control unit 67 applies the negative voltage to the charging roller 14Bk, thereby uniformly charging the surface of the photosensitive drum 13Bk.

In the next step, the print control unit 61 sends an instruction to the head control unit 69 for exposure, so that the head control unit 69 drives the LED head 15Bk. When the LED head 15Bk irradiates for a specific period of time determined in advance, a static latent image is formed on the surface of the photosensitive drum 13Bk.

In the next step, deteriorated toner is supplied from the toner cartridge 20Bk to the toner supply roller 18Bk, and is further supplied to the developing roller 16Bk through the toner supply roller 18Bk. After deteriorated toner is supplied to the developing roller 16Bk, the developing blade 19Bk charges deteriorated toner, so that deteriorated toner is attached to the static latent image, thereby developing the static latent image to form a toner image.

In the next step, the print control unit 61 sends an instruction to the transfer voltage control unit 73 to apply a specific voltage, i.e., a positive voltage of about +3,000 V. Accordingly, the transfer voltage control unit 73 applies the positive voltage to the transfer roller 17Bk, thereby transferring the toner image to the transport belt 21.

In the next step, while the transport belt 21 moves, when the toner image on the transport belt 21 reaches the transport belt blade 34, the transport belt blade 34 scrapes off deteriorated toner forming the toner image, so that deteriorated toner is collected in the transport belt waste toner box 35. Similarly, the process described above is repeated in the image forming units 12Y, 12M, and 12C for discharging deteriorated toner.

Figure 4:
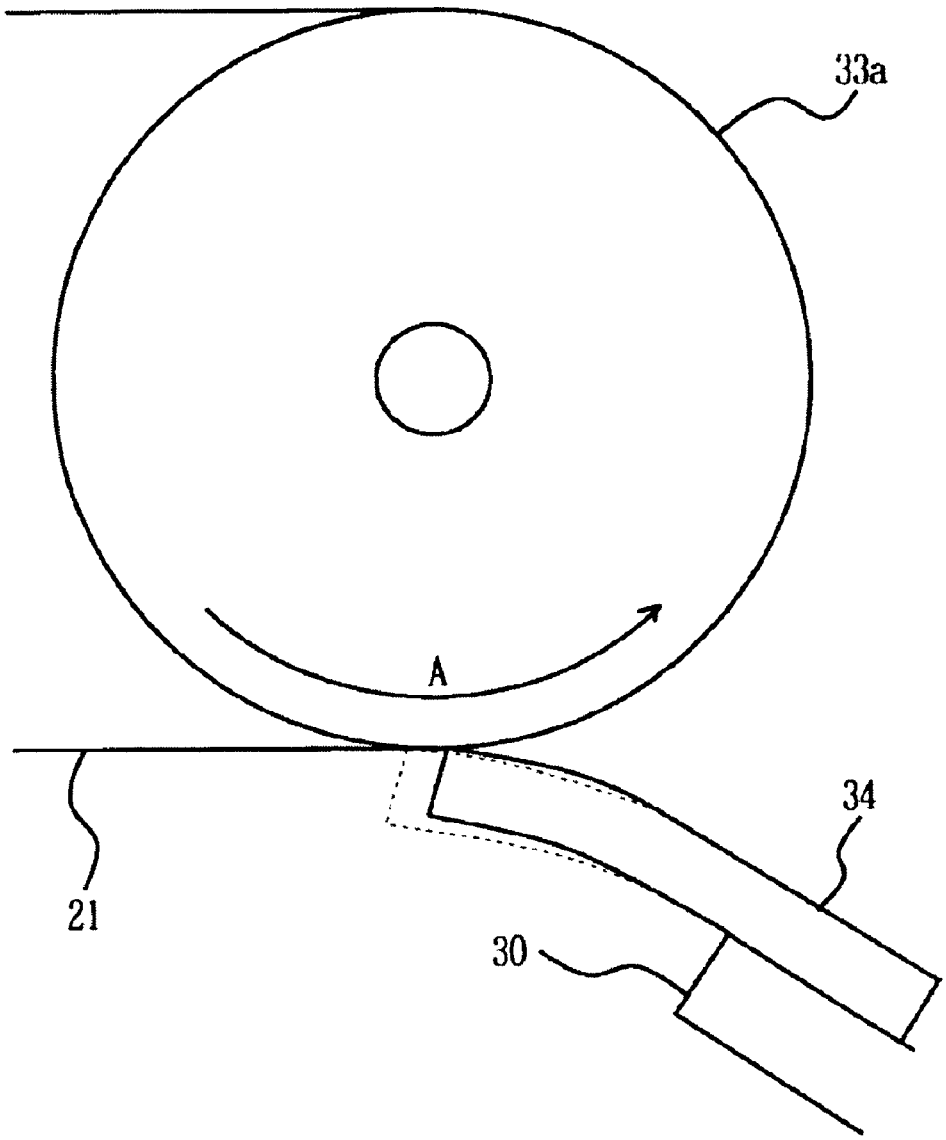
FIG. 4 is a schematic sectional view showing a transport belt blade of the printer according to the first embodiment of the present invention.

An operation of scraping off the toner image transferred to the transport belt 21 with the transport belt blade 34 will be explained next. FIG. 4 is a schematic sectional view showing the transport belt blade 34 of the printer 11 according to the first embodiment of the present invention.

As shown in FIG. 4, the transport belt blade 34 is fixed to a blade holder 30 or a supporting member formed of a metal plate member with an adhesive (not shown). A distal end portion of the transport belt blade 34 abuts against the transport belt 21 extending in a state of winding around a surface of the transport belt follower roller 33*a*.

When the transport belt 21 does not move, the distal end portion of the transport belt blade 34 abuts against the transport belt 21 in a normal state indicated with a hidden line. When the transport motor 88 drives the transport belt follower roller 33*a* to rotate in an arrow direction A, and the transport belt 21 moves, the distal end portion of the transport belt blade 34 abuts against the transport belt 21 in a driven state indicated with a solid line through a frictional force between the distal end portion of the transport belt blade 34 and the transport belt 21. Afterward, when the transport belt 21 stops, the distal end portion of the transport belt blade 34 returns to the normal state.

As described above, every time the printing operation is performed on one sheet, the distal end portion of the transport belt blade 34 repeatedly moves between the normal state and the driven state accompanied with the movement or the stop of the transport belt 21.

When the printing operation is performed continuously, the transport belt 21 moves continuously without stopping. Accordingly, the distal end portion of the transport belt blade 34 is maintained in the driven state. In the driven state, the transport belt blade 34 removes toner (fog toner) attached to the surface of the transport belt 21 or other foreign objects such as paper powder, dust, and the likes.

When the printing operation is performed continuously, a foreign object may be accumulated at an abutting portion between the transfer belt 21 and the transport belt blade 34. In this case, if deteriorated toner is discharged to the transport belt 21 between sheets (a period of time between sheets) in the continuous printing operation while the foreign object is accumulated at the abutting portion, it is difficult to scrape off deteriorated toner at the abutting portion where the foreign object is accumulated, thereby causing a problem in cleaning.

To this end, in the embodiment, the print control unit 61 includes a deteriorated developer discharge process unit (not shown) for performing a deteriorated developer discharge process. More specifically, in the continuous printing operation, before deteriorated toner is discharged, it is configured to temporarily stop the photosensitive drums 13Bk, 13Y, 13M, and 13C; the transport belt follower roller 33*a*; and the transport belt 21.

Figure 5:
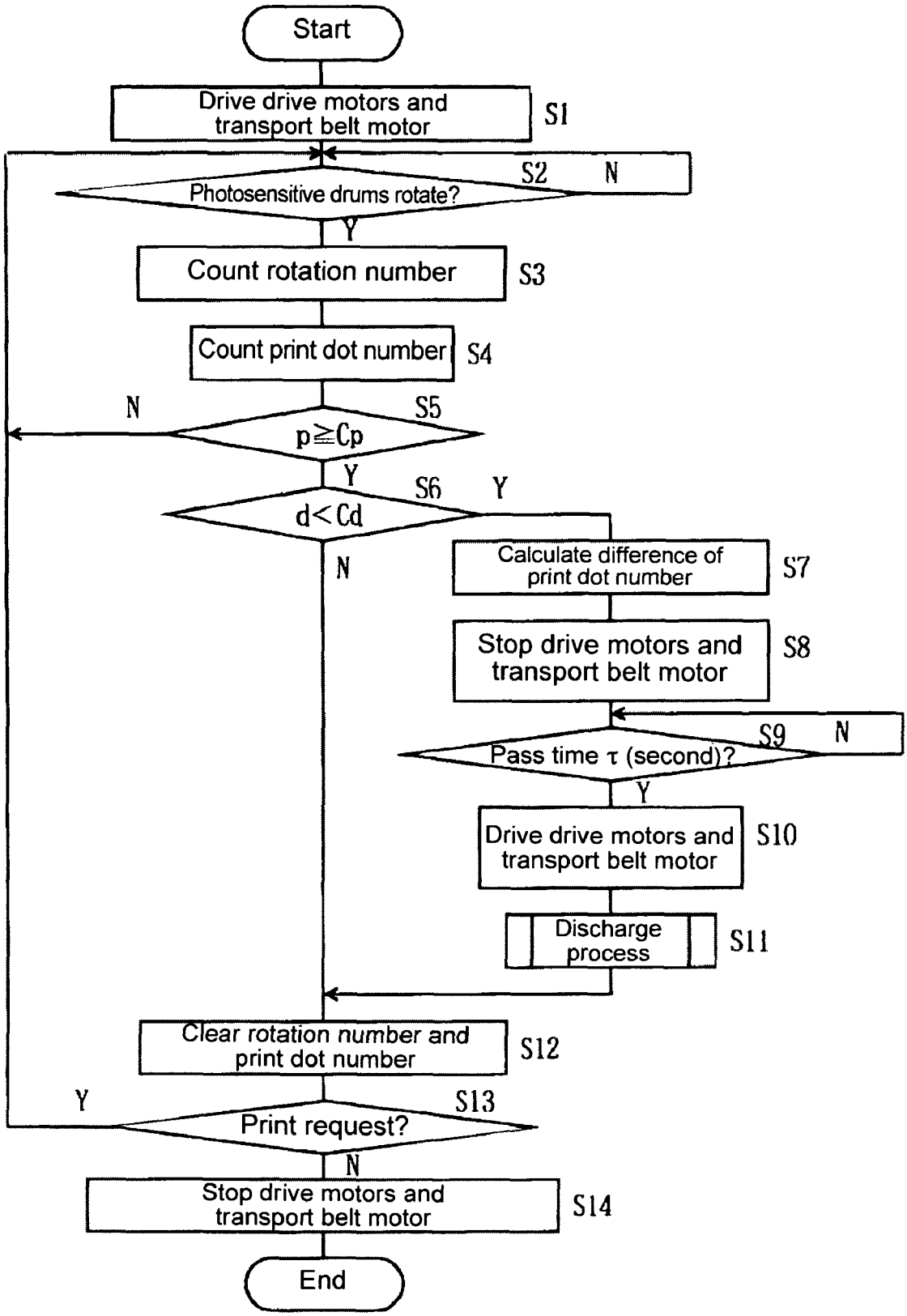
FIG. 5 is a flow chart showing an operation of a deteriorated developer discharge process unit of the printer according to the first embodiment of the present invention.
Figure 6:
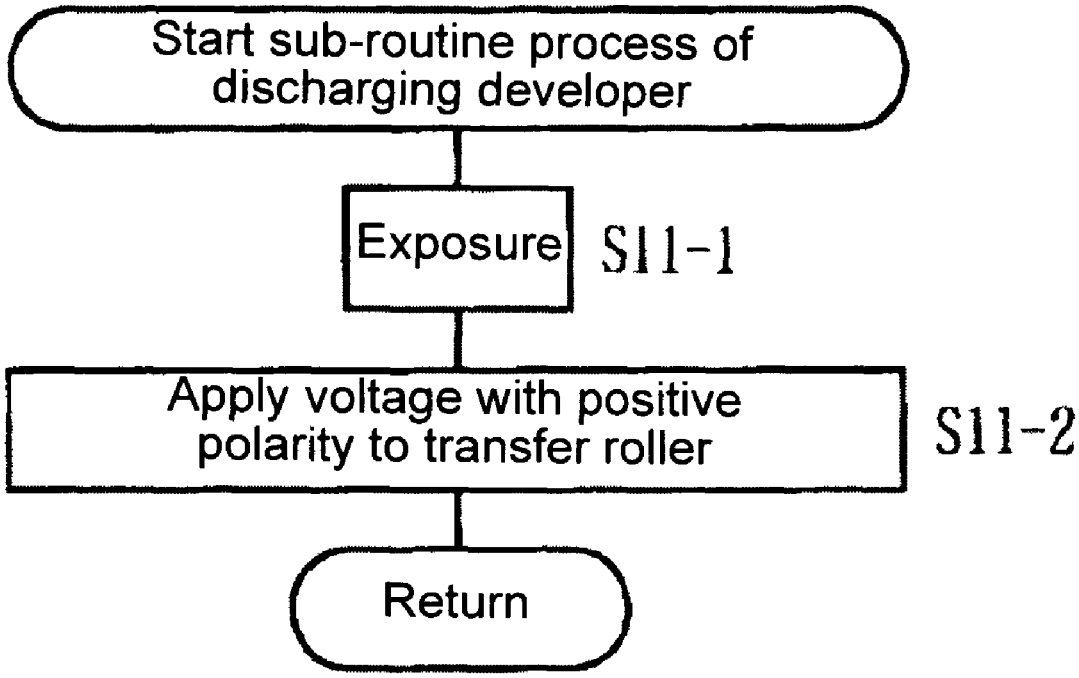
FIG. 6 is a flow chart showing the operation of the printer in a sub-routine process of discharging developer according to the first embodiment of the present invention.
Figure 7:
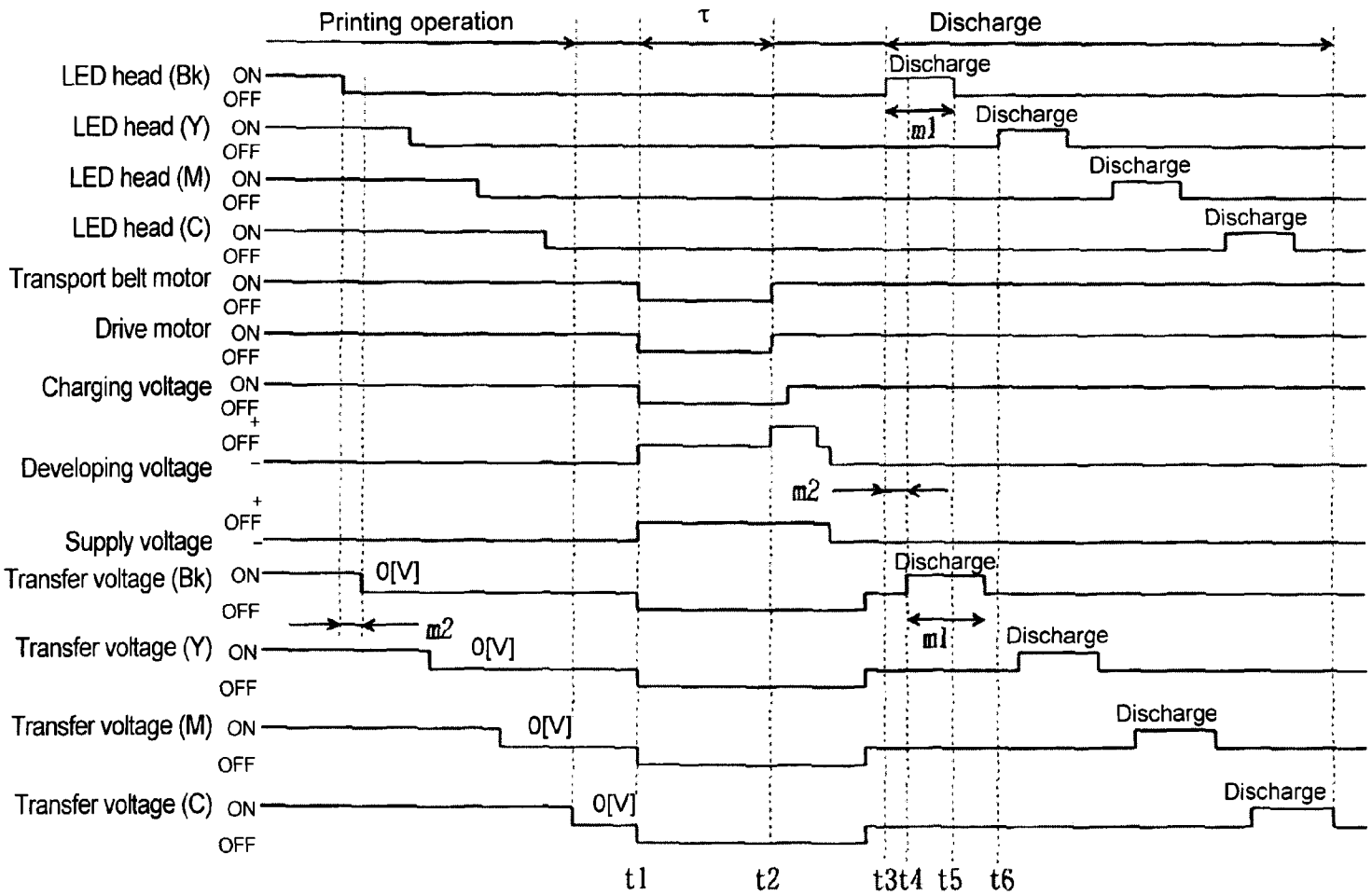
FIG. 7 is a time chart showing the operation of the deteriorated developer discharge process unit of the printer according to the first embodiment of the present invention.

An operation of the deteriorated developer discharge process unit will be explained next. FIG. 5 is a flow chart showing the operation of the deteriorated developer discharge process unit of the printer 11 according to the first embodiment of the present invention. FIG. 6 is a flow chart showing the operation of the printer 11 in a sub-routine process of discharging developer according to the first embodiment of the present invention. FIG. 7 is a time chart showing the operation of the deteriorated developer discharge process unit of the printer 11 according to the first embodiment of the present invention.

In the embodiment, among the image forming units 12Bk, 12Y, 12M, and 12C, in the image forming unit 12Bk, for example, it is configured such that the photosensitive drum rotation number counter 61*c* counts a rotation number p of the photosensitive drum 13Bk, and the print dot counter 61*d* counts a print dot number d. The rotation number p of the photosensitive drum 13Bk and the print dot number d are parameters for determining an extent of deterioration of toner.

When the printing operation starts, a drive process unit of the deteriorated developer discharge process unit performs a drive process to send an instruction to the drive motor control unit 75 and the transport belt motor control unit 79. Accordingly, the drive motors 77Bk, 77Y, 77M, and 77C and the transport belt motor 80 are driven to rotate the photosensitive drums 13Bk, 13Y, 13M, and 13C and move the transport belt 21.

In the next step, a developer deterioration parameter obtaining process unit of the deteriorated developer discharge process unit performs a developer deterioration parameter obtaining process. More specifically, the developer deterioration parameter obtaining process unit waits for the photosensitive drums 13Bk, 13Y, 13M, and 13C to rotate. When the photosensitive drums 13Bk, 13Y, 13M, and 13C start rotating, the photosensitive drum rotation number counter 61*c* counts the rotation number p of the photosensitive drum 13Bk (a value of the photosensitive drum rotation number counter 61*c*). Further, the print dot counter 61*d* counts a print dot number d (a value of the print dot counter 61*d*).

In the next step, a deterioration condition determining process unit of the deteriorated developer discharge process unit performs a deterioration condition determining process. More specifically, the deterioration condition determining process unit retrieves the rotation number p, and determines whether a first deterioration condition is met through determining whether the rotation number p is greater than a threshold value Cp determined in advance. When the rotation number p is greater than the threshold value Cp, the deterioration condition determining process unit determines that the first deterioration condition is met and developer is deteriorated.

In the next step, the deterioration condition determining process unit retrieves the print dot number d, and determines whether a second deterioration condition is met through determining whether the print dot number d is less than a threshold value Cd. When the print dot number d is smaller than the threshold value Cd, the deterioration condition determining process unit determines that the second deterioration condition is met and developer is deteriorated. The threshold value Cd represents a print dot number when the photosensitive drum 13Bk rotates for the rotational number p at a necessary print duty.

As the rotational number p of the photosensitive drum 13Bk increases, when a uniform layer of toner is formed on the developing rollers 16Bk, 16Y, 16M, and 16C, a physical force is applied to toner. Further, after toner remains on the photosensitive drums 13Bk, 13Y, 13M, and 13C without moving to the sheet upon transferring the toner images, the charging rollers 14Bk, 14Y, 14M, and 14C apply a physical force to toner, thereby deteriorating toner. Further, as the print dot number d decreases, the print duty decreases. Accordingly, a small amount of toner is used, and the physical force is applied to toner more often, thereby deteriorating toner more easily.

To this end, as described above, when the rotation number p is greater than the threshold value Cp, and the print dot number d is less than the threshold value Cd, the deterioration condition determining process unit determines that toner is deteriorated. When the rotation number p is greater than the threshold value Cp, and the print dot number d is greater than the threshold value Cd, a large amount of toner is used, and toner is consumed before being deteriorated. Accordingly, the deterioration condition determining process unit determines that toner is not deteriorated.

When the deterioration condition determining process unit determines that toner is deteriorated, a deterioration state determining process unit of the deteriorated developer discharge process unit performs a deterioration state determining process. More specifically, the deterioration state determining process unit calculates a difference Δd of the print dot number d through subtracting the print dot number d from the threshold value Cd. The difference Δd represents a deterioration state of toner, and increases as the print duty decreases and toner is deteriorated to a further extent.

In the next step, a drive termination process unit of the deteriorated developer discharge process unit performs a drive termination process to temporarily stop the image forming units 12Bk, 12Y, 12M, and 12C. More specifically, the drive termination process unit stops the drive motors 77Bk, 77Y, 77M, and 77C, and the transport belt motor 80 for a specific period of time, i.e., a period of time τ (second) from a timing t1 to a timing t2 shown in FIG. 7, thereby stopping the photosensitive drums 13Bk, 13Y, 13M, and 13C, and the transport belt 21. It is determined whether the period of time τ passes according to a measurement of the timer 61*a*.

After the period of time τ passes, the drive process unit drives the drive motors 77Bk, 77Y, 77M, and 77C and the transport belt motor 80 to rotate the photosensitive drums 13Bk, 13Y, 13M, and 13C and move the transport belt 21.

In the next step, a discharge process unit of the deteriorated developer discharge process unit performs a discharge process. More specifically, the photosensitive drums 13Bk, 13Y, 13M, and 13C are exposed over entire surfaces thereof in a width direction for a specific period of time, i.e., a period of time m1 (second) according to the difference Δd. Afterward, a voltage with a positive polarity (about +2,000 V in the embodiment) is applied to the transfer rollers 17Bk, 17Y, 17M, and 17C for the period of time m1 (second). For example, the LED head 15Bk exposes the entire surface of the photosensitive drum 13Bk in the width direction thereof for the period of time m1 (second) from a timing t3 to a timing t5. Then, the LED head 15Y exposes the entire surface of the photosensitive drum 13Y at a timing t6.

With the discharge process described above, deteriorated toner attaches to the photosensitive drums 13Bk, 13Y, 13M, and 13C, and then is transferred to the transport belt 21. Accordingly, during the continuous printing operation, it is possible to discharge deteriorated toner to the transport belt 21 between the sheets. When portions of the photosensitive drums 13Bk, 13Y, 13M, and 13C exposed with the LED heads 15Bk, 15Y, 15M, and 15C take a period of time m2 (second) to reach positions facing the transfer rollers 17Bk, 17Y, 17M, and 17C, the voltage with a positive polarity is applied to the transfer rollers 17Bk, 17Y, 17M, and 17C after the period of time m2 (second) after the entire surfaces of the photosensitive drums 13Bk, 13Y, 13M, and 13C are exposed.

In the embodiment, a storage unit (not shown) disposed in the print control unit 61 stores a table correlating the difference Δd to an exposure time, i.e., a period of time that the photosensitive drums 13Bk, 13Y, 13M, and 13C are exposed. In the table, when the difference Δd increases, the exposure time increases. Accordingly, it is possible to increase the areas of the photosensitive drums 13Bk, 13Y, 13M, and 13C where deteriorated toner is attached, thereby increasing an amount of deteriorated toner thus discharged. On the other hand, in the table, when the difference Δd decreases, the exposure time decreases. Accordingly, it is possible to decrease the areas of the photosensitive drums 13Bk, 13Y, 13M, and 13C where deteriorated toner is attached, thereby decreasing an amount of deteriorated toner thus discharged.

In the embodiment, a discharge amount determining process unit of the deteriorated developer discharge process unit performs a discharge amount determining process for determining and adjusting a discharge amount of deteriorated toner according to the rotation number p of the photosensitive drums 13Bk, 13Y, 13M, and 13C and the print dot number d.

As described above, in the embodiment, the exposure time is determined according to the difference Δd. When the difference Δd is greater than a threshold value determined in advance, it is possible to expose the photosensitive drums 13Bk, 13Y, 13M, and 13C for a specific exposure time.

When the print dot number d is greater than the threshold value Cd, a post treatment process unit of the deteriorated developer discharge process unit performs a post treatment process after the discharge process unit completes the discharge process. More specifically, the post treatment process unit clears the rotation number p and the dot print number d, and determines whether there is a print request for a next job or a next page. When there is no print request for a next job or a next page, the post treatment process unit stops the drive motors 77Bk, 77Y, 77M, and 77C and the transport belt motor 80.

As described above, in the embodiment, when it is determined that toner is deteriorated, the transport belt 21 stops for the specific period of time before toner is discharged, and the distal end portion of the transport belt blade 34 returns from the drive state to the normal state. At this moment, a foreign object accumulated at the abutting portion between the transport belt 21 and the transport belt blade 34 is removed from the abutting portion, so that the transport belt blade 34 collects the foreign object in the transport belt waste toner box 35. Accordingly, during the continuous printing operation, when toner is discharged, it is possible to scrape off deteriorated toner on the transport belt 21 with the transport belt blade 34, thereby preventing a problem in cleaning.

The flow chart shown in FIG. 5 will be explained next. In step S1, the drive motors 77Bk, 77Y, 77M, and 77C and the transport belt motor 80 are driven. In step S2, the process waits for the photosensitive drums 13Bk, 13Y, 13M, and 13C to rotate. When the photosensitive drums 13Bk, 13Y, 13M, and 13C start rotating, the process proceeds to step S3. In step S3, the photosensitive drum rotation number counter 61*c* counts the rotation number p of the photosensitive drum 13Bk. In step S4, the print dot counter 61*d* counts the print dot number d.

In step S5, it is determined whether the rotation number p of the photosensitive drum 13Bk is greater than the threshold value Cp. When the rotation number p is greater than the threshold value Cp, the process proceeds to step S6. When the rotation number p is smaller than the threshold value Cp, the process returns to step S2.

In step S6, it is determined whether the print dot number d is less than the threshold value Cd. When the print dot number d is smaller than the threshold value Cd, the process proceeds to step S7. When the print dot number d is greater than the threshold value Cd, the process proceeds to step S12.

In step S7, the difference Δd of the print dot number d is calculated. In step S8, the drive motors 77Bk, 77Y, 77M, and 77C and the transport belt motor 80 are stopped. In step S9, the process waits for the period of time τ (second). When the period of time τ (second) passes, the process proceeds to step S10. In step S10, the drive motors 77Bk, 77Y, 77M, and 77C and the transport belt motor 80 are driven. In step S1, the discharge process is performed.

In step S12, the rotation number p and the print dot number d are cleared. In step S13, it is determined whether there is the print request. When there is the print request, the process returns to step S2. When there is no print request, the process proceeds to step S14. In step S14, the drive motors 77Bk, 77Y, 77M, and 77C and the transport belt motor 80 are stopped, thereby completing the process.

The flow chart shown in FIG. 6 will be explained next. In step S111, the photosensitive drums 13Bk, 13Y, 13M, and 13C are exposed. In step S11-2, the voltage with a positive polarity is applied to the transfer roller 17Bk, thereby returning to the process.

Second Embodiment

A second embodiment of the present invention will be explained next. In the first embodiment, it is configured such that deteriorated toner is discharged to the transport belt 21, and it may be configured such that deteriorated toner is discharged to the photosensitive drums 13Bk, 13Y, 13M, and 13C. In the second embodiment, it is configured such that deteriorated toner is discharged to the photosensitive drums 13Bk, 13Y, 13M, and 13C. Components in the second embodiment similar to those in the first embodiment are designated with the same reference numerals, and explanations thereof are omitted. The components in the second embodiment similar to those in the first embodiment provide effects similar to those in the first embodiment.

In the embodiment, the image forming units 12Bk, 12Y, 12M, and 12C have an identical configuration, and a process of discharging deteriorated toner to the image forming unit 12Bk will be explained.

In the image forming unit 12Bk, when the print control unit 61 sends the instruction to the charging voltage control unit 67 to apply a specific voltage, for example, a negative voltage of about −1,000 V, the charging voltage control unit 67 applies the negative voltage to the charging roller 14Bk, thereby uniformly charging the surface of the photosensitive drum 13Bk as the image supporting member or the photosensitive member.

In the next step, the print control unit 61 sends the instruction to the head control unit 69 for exposure, so that the head control unit 69 drives the LED head 15Bk. When the LED head 15Bk irradiates for a specific period of time determined in advance, a static latent image is formed on the surface of the photosensitive drum 13Bk.

In the next step, deteriorated toner is supplied from the toner cartridge 20Bk to the toner supply roller 18Bk, and is further supplied to the developing roller 16Bk through the toner supply roller 18Bk. After deteriorated toner is supplied to the developing roller 16Bk, the developing blade 19Bk charges deteriorated toner, so that deteriorated toner is attached to the static latent image, thereby developing the static latent image to form a toner image.

In the next step, the print control unit 61 sends the instruction to the transfer voltage control unit 73 to apply a specific voltage, i.e., 0 V in the embodiment. Accordingly, the transfer voltage control unit 73 applies the voltage of 0 V to the transfer roller 17Bk, thereby maintaining the toner image attached to the photosensitive drum 13Bk.

While the photosensitive drum 13Bk rotates, the toner image on the photosensitive drum 13Bk moves. When the toner image reaches the cleaning blade 36Bk as the first cleaning member or the first removing member, the cleaning blade 36Bk scrapes off the toner image, thereby collecting the toner image in a photosensitive drum waste toner box (not shown) as a second developer container. Similarly, the process described above is repeated in the image forming units 12Y, 12M, and 12C for discharging deteriorated toner.

Figure 8:
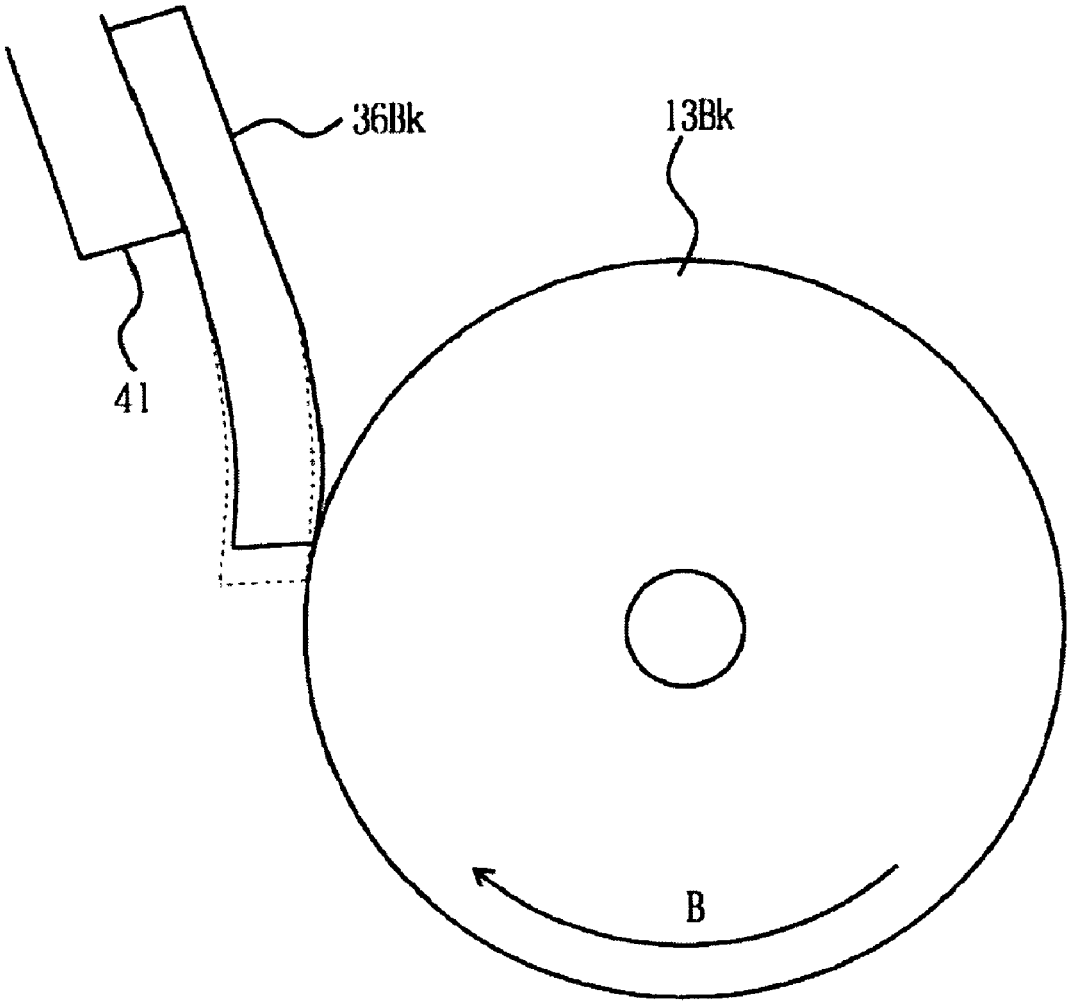
FIG. 8 is a schematic sectional view showing a cleaning blade of a printer according to a second embodiment of the present invention.

An operation of scraping off the toner image transferred to the photosensitive drum 13Bk with the cleaning blade 36Bk will be explained next. FIG. 8 is a schematic sectional view showing the cleaning blade 36Bk of the printer 11 according to the second embodiment of the present invention.

As shown in FIG. 8, the cleaning blade 36Bk is fixed to a blade holder 41 or a supporting member formed of a metal plate member with an adhesive (not shown). A distal end portion of the cleaning blade 36Bk abuts against the photosensitive drum 13Bk.

When the photosensitive drum 13Bk does not rotate, the distal end portion of the cleaning blade 36Bk abuts against the photosensitive drum 13Bk in a normal state indicated with a hidden line. When the drive motor 77Bk drives the photosensitive drum 13Bk to rotate in an arrow direction B, the distal end portion of the cleaning blade 36Bk abuts against the photosensitive drum 13Bk in a driven state indicated with a solid line through a frictional force between the distal end portion of the cleaning blade 36Bk and the photosensitive drum 13Bk. Afterward, when the photosensitive drum 13Bk stops rotating, the distal end portion of the cleaning blade 36Bk returns to the normal state.

As described above, every time the printing operation is performed on one sheet, the distal end portion of the cleaning blade 36Bk repeatedly moves between the normal state and the driven state accompanied with the rotation or the stop of the photosensitive drum 13Bk.

When the printing operation is performed continuously, the photosensitive drum 13Bk rotates continuously without stopping. Accordingly, the distal end portion of the cleaning blade 36Bk is maintained in the driven state. In the driven state, the cleaning blade 36Bk removes toner (fog toner) attached to the surface of the photosensitive drum 13Bk or other foreign objects.

When the printing operation is performed continuously, a foreign object may be accumulated at an abutting portion between the photosensitive drum 13Bk and the cleaning blade 36Bk. In this case, if deteriorated toner is discharged to the photosensitive drum 13Bk between sheets in the continuous printing operation while the foreign object is accumulated at the abutting portion, it is difficult to scrape off deteriorated toner at the abutting portion where the foreign object is accumulated, thereby causing a problem in cleaning.

To this end, in the embodiment, upon performing the deteriorated developer discharge process during the continuous printing operation, before deteriorated toner is discharged, the deteriorated developer discharge process unit temporarily stops the photosensitive drums 13Bk, 13Y, 13M, and 13C.

Figure 9:
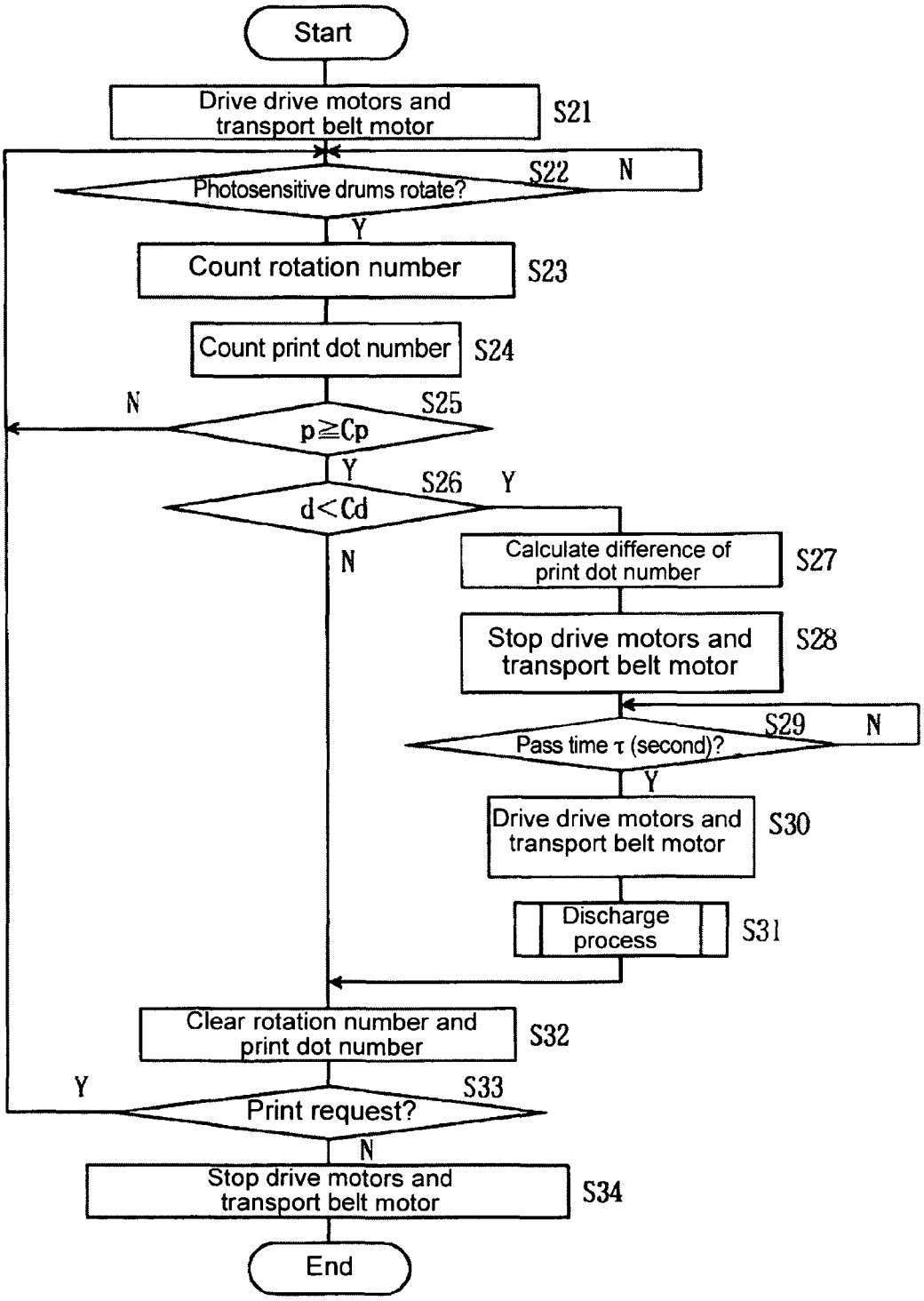
FIG. 9 is a flow chart showing an operation of a deteriorated developer discharge process unit of the printer according to the second embodiment of the present invention.
Figure 10:
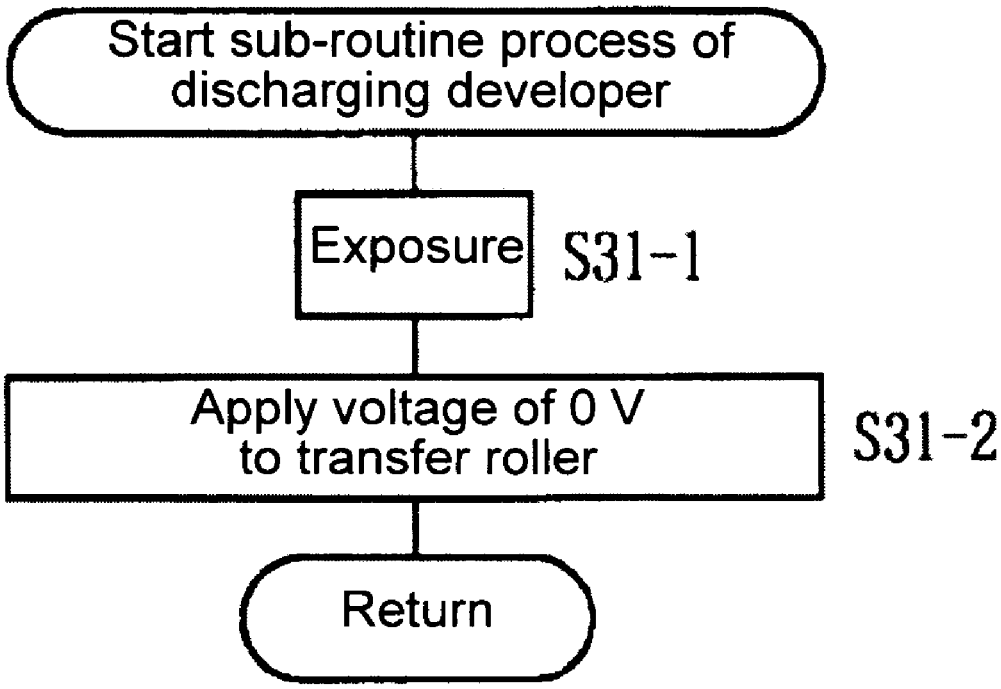
FIG. 10 is a flow chart showing the operation of the printer in a sub-routine process of discharging developer according to the second embodiment of the present invention.
Figure 11:
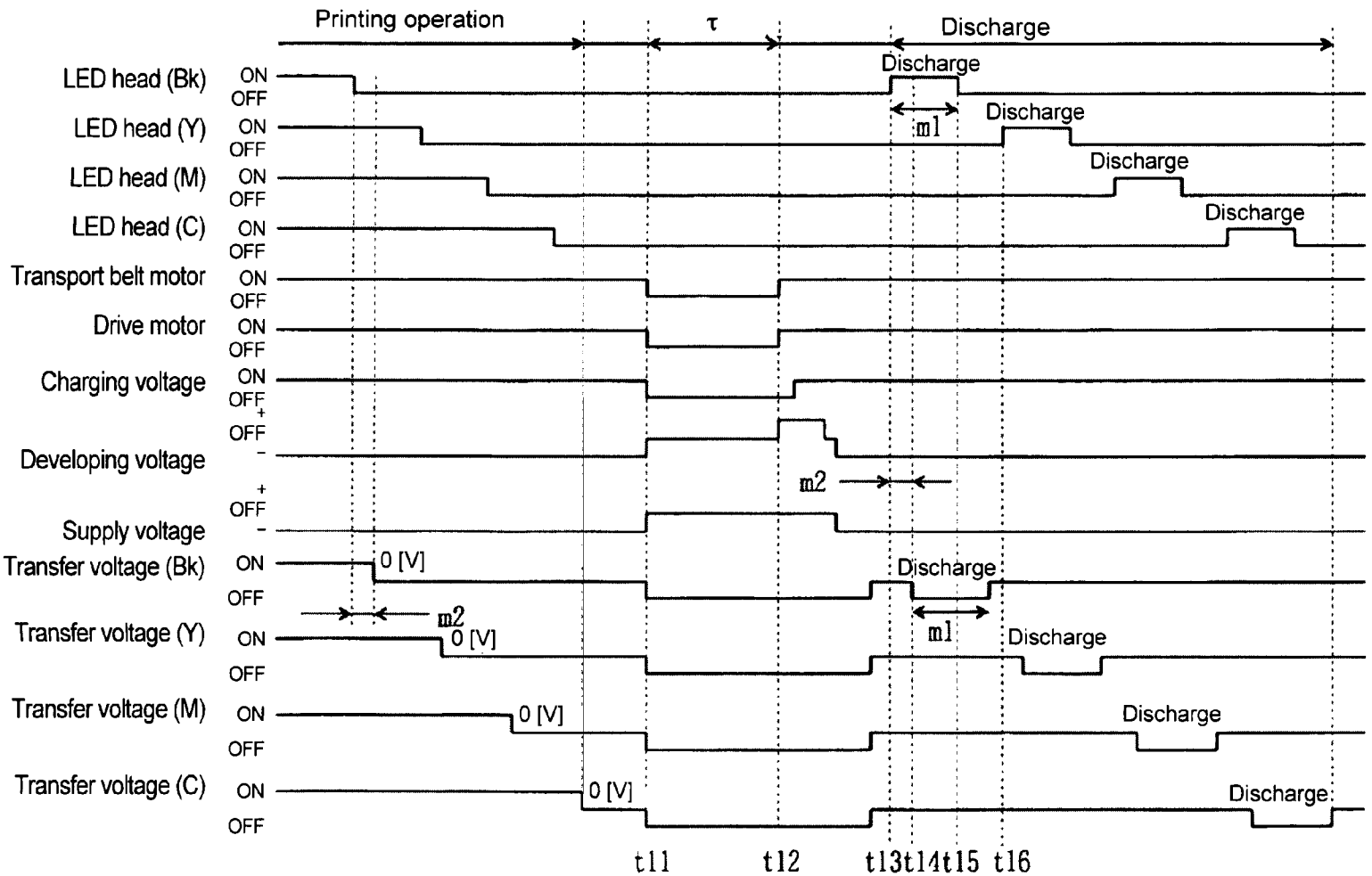
FIG. 11 is a time chart showing the operation of the deteriorated developer discharge process unit of the printer according to the second embodiment of the present invention.

An operation of the deteriorated developer discharge process unit will be explained next. FIG. 9 is a flow chart showing the operation of the deteriorated developer discharge process unit of the printer 11 according to the second embodiment of the present invention. FIG. 10 is a flow chart showing the operation of the printer 11 in a sub-routine process of discharging developer according to the second embodiment of the present invention. FIG. 11 is a time chart showing the operation of the deteriorated developer discharge process unit of the printer according to the second embodiment of the present invention.

In the embodiment, the drive termination process unit of the deteriorated developer discharge process unit stops the drive motors 77Bk, 77Y, 77M, and 77C, and the transport belt motor 80 for a specific period of time, i.e., a period of time τ0 (second) from a timing t11 to a timing t12 shown in FIG. 11, thereby stopping the photosensitive drums 13Bk, 13Y, 13M, and 13C, and the transport belt 21.

After the period of time τ passes, the drive process unit drives the drive motors 77Bk, 77Y, 77M, and 77C and the transport belt motor 80 to rotate the photosensitive drums 13Bk, 13Y, 13M, and 13C and move the transport belt 21.

In the next step, similar to the first embodiment, the discharge process unit of the deteriorated developer discharge process unit exposes the photosensitive drums 13Bk, 13Y, 13M, and 13C over the entire surfaces thereof in the width direction for the period of time m1 (second). Afterward, a voltage of 0 V is applied to the transfer rollers 17Bk, 17Y, 17M, and 17C for the period of time m1 (second). For example, the LED head 15Bk exposes the entire surface of the photosensitive drum 13Bk in the width direction thereof for the period of time m1 (second) from a timing t13 to a timing t15. Then, the LED head 15Y exposes the entire surface of the photosensitive drum 13Y at a timing t16.

With the discharge process described above, deteriorated toner attaches to the photosensitive drums 13Bk, 13Y, 13M, and 13C. Accordingly, during the continuous printing operation, it is possible to discharge deteriorated toner to the photosensitive drums 13Bk, 13Y, 13M, and 13C between the sheets. When portions of the photosensitive drums 13Bk, 13Y, 13M, and 13C exposed with the LED heads 15Bk, 15Y, 15M, and 15C take a period of time m2 (second) to reach positions facing the transfer rollers 17Bk, 17Y, 17M, and 17C, the voltage of 0 V is applied to the transfer rollers 17Bk, 17Y, 17M, and 17C after the period of time m2 (second) after the entire surfaces of the photosensitive drums 13Bk, 13Y, 13M, and 13C are exposed.

As described above, in the embodiment, when it is determined that toner is deteriorated, the photosensitive drums 13Bk, 13Y, 13M, and 13C stop for the specific period of time before toner is discharged, and the distal end portions of the cleaning blades 36Bk, 36Y, 36M, and 36C return from the drive state to the normal state. At this moment, foreign objects accumulated at the abutting portions between the photosensitive drums 13Bk, 13Y, 13M, and 13C and the cleaning blades 36Bk, 36Y, 36M, and 36C are removed from the abutting portions and collected in the photosensitive drum waste toner box. Accordingly, during the continuous printing operation, when deteriorated toner is discharged, it is possible to scrape off deteriorated toner on the photosensitive drums 13Bk, 13Y, 13M, and 13C with the cleaning blades 36Bk, 36Y, 36M, and 36C, thereby preventing a problem in cleaning.

Further, in the second embodiment, as opposed to the first embodiment, deteriorated toner is discharged to the photosensitive drums 13Bk, 13Y, 13M, and 13C, not to the transport belt 21. Accordingly, it is possible to prevent the transport belt 21 from being stained with deteriorated toner. Further, it is possible to reduce a capacity of the transport belt waste toner box 35.

The flow chart shown in FIG. 9 will be explained next. In step S21, the drive motors 77Bk, 77Y, 77M, and 77C and the transport belt motor 80 are driven. In step S22, the process waits for the photosensitive drums 13Bk, 13Y, 13M, and 13C to rotate. When the photosensitive drums 13Bk, 13Y, 13M, and 13C start rotating, the process proceeds to step S23. In step S23, the photosensitive drum rotation number counter 61*c* counts the rotation number p of the photosensitive drum 13Bk. In step S24, the print dot counter 61*d* counts the print dot number d.

In step S25, it is determined whether the rotation number p of the photosensitive drum 13Bk is greater than the threshold value Cp. When the rotation number p is greater than the threshold value Cp, the process proceeds to step S26. When the rotation number p is smaller than the threshold value Cp, the process returns to step S22.

In step S26, it is determined whether the print dot number d is less than the threshold value Cd. When the print dot number d is smaller than the threshold value Cd, the process proceeds to step S27. When the print dot number d is greater than the threshold value Cd, the process proceeds to step S32.

In step S27, the difference Δd of the print dot number d is calculated. In step S28, the drive motors 77Bk, 77Y, 77M, and 77C and the transport belt motor 80 are stopped. In step S29, the process waits for the period of time τ (second). When the period of time τ (second) passes, the process proceeds to step S30. In step S30, the drive motors 77Bk, 77Y, 77M, and 77C and the transport belt motor 80 are driven. In step S31, the discharge process is performed.

In step S32, the rotation number p and the print dot number d are cleared. In step S33, it is determined whether there is the print request. When there is the print request, the process returns to step S22. When there is no print request, the process proceeds to step S34. In step S34, the drive motors 77Bk, 77Y, 77M, and 77C and the transport belt motor 80 are stopped, thereby completing the process.

The flow chart shown in FIG. 10 will be explained next. In step S31-1, the photosensitive drums 13Bk, 13Y, 13M, and 13C are exposed. In step S31-2, the voltage of 0 V is applied to the transfer roller 17Bk, thereby returning to the process.

Third Embodiment

A third embodiment of the present invention will be explained next. In the first and second embodiments, the cleaning blades 36Bk, 36Y, 36M, and 36C and the transport belt blade 34 are formed of an elastic material such as urethane rubber. Accordingly, the cleaning blades 36Bk, 36Y, 36M, and 36C and the transport belt blade 34 are susceptible to an environmental condition such as a temperature at which the printer 11 is used. More specifically, the cleaning blades 36Bk, 36Y, 36M, and 36C and the transport belt blade 34 tend to be hardened as a temperature decreases, thereby causing a problem in cleaning.

In the third embodiment, to this end, the cleaning blades 36Bk, 36Y, 36M, and 36C and the transport belt blade 34 are stopped at different timings according to an internal temperature of the printer 11. Components in the third embodiment similar to those in the first and second embodiments are designated with the same reference numerals, and explanations thereof are omitted. The components in the third embodiment similar to those in the first and second embodiments provide effects similar to those in the first and second embodiments.

Figure 12:
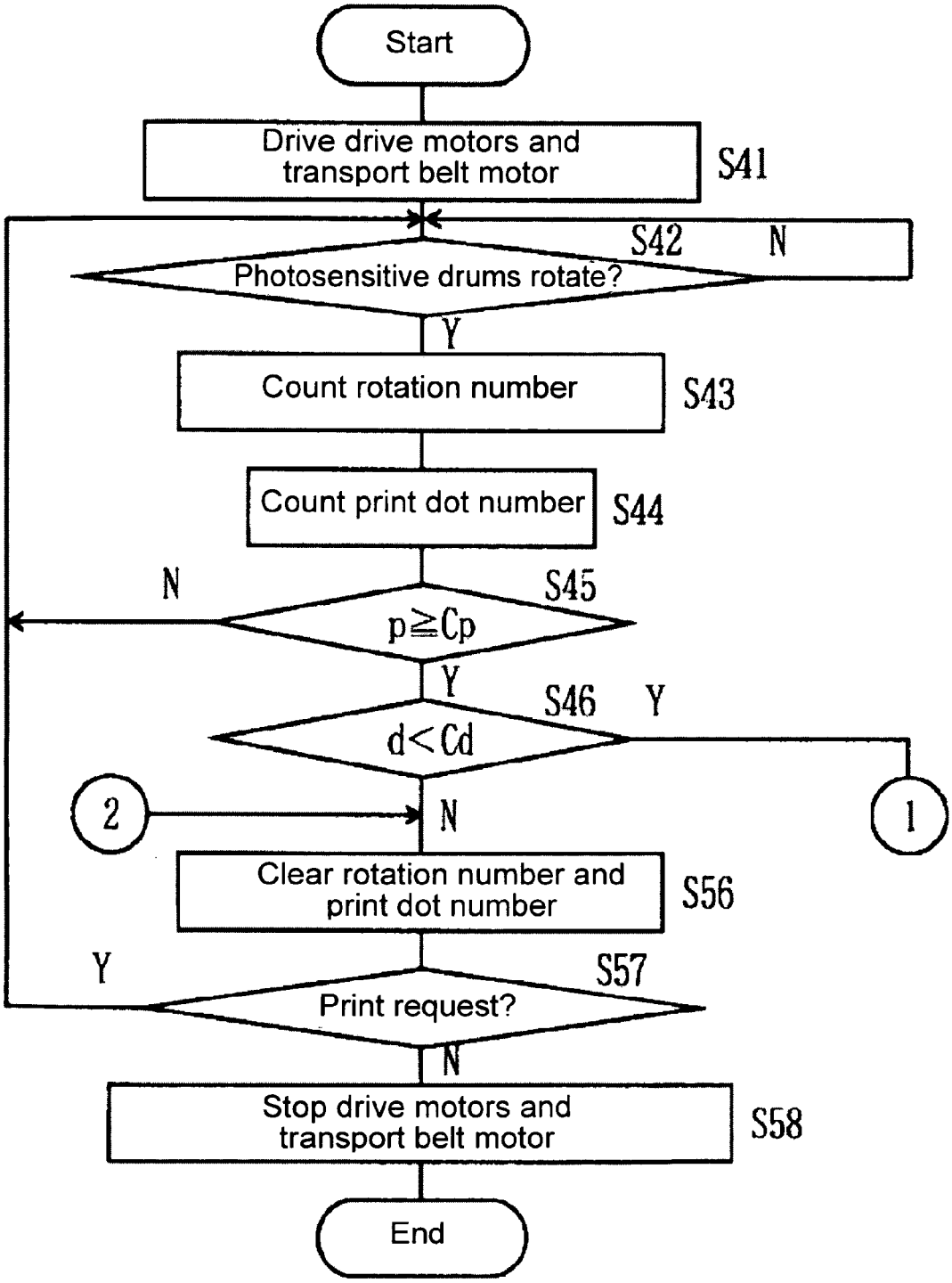
FIG. 12 is a flow chart No. 1 showing an operation of a deteriorated developer discharge process unit of a printer according to a third embodiment of the present invention.
Figure 13:
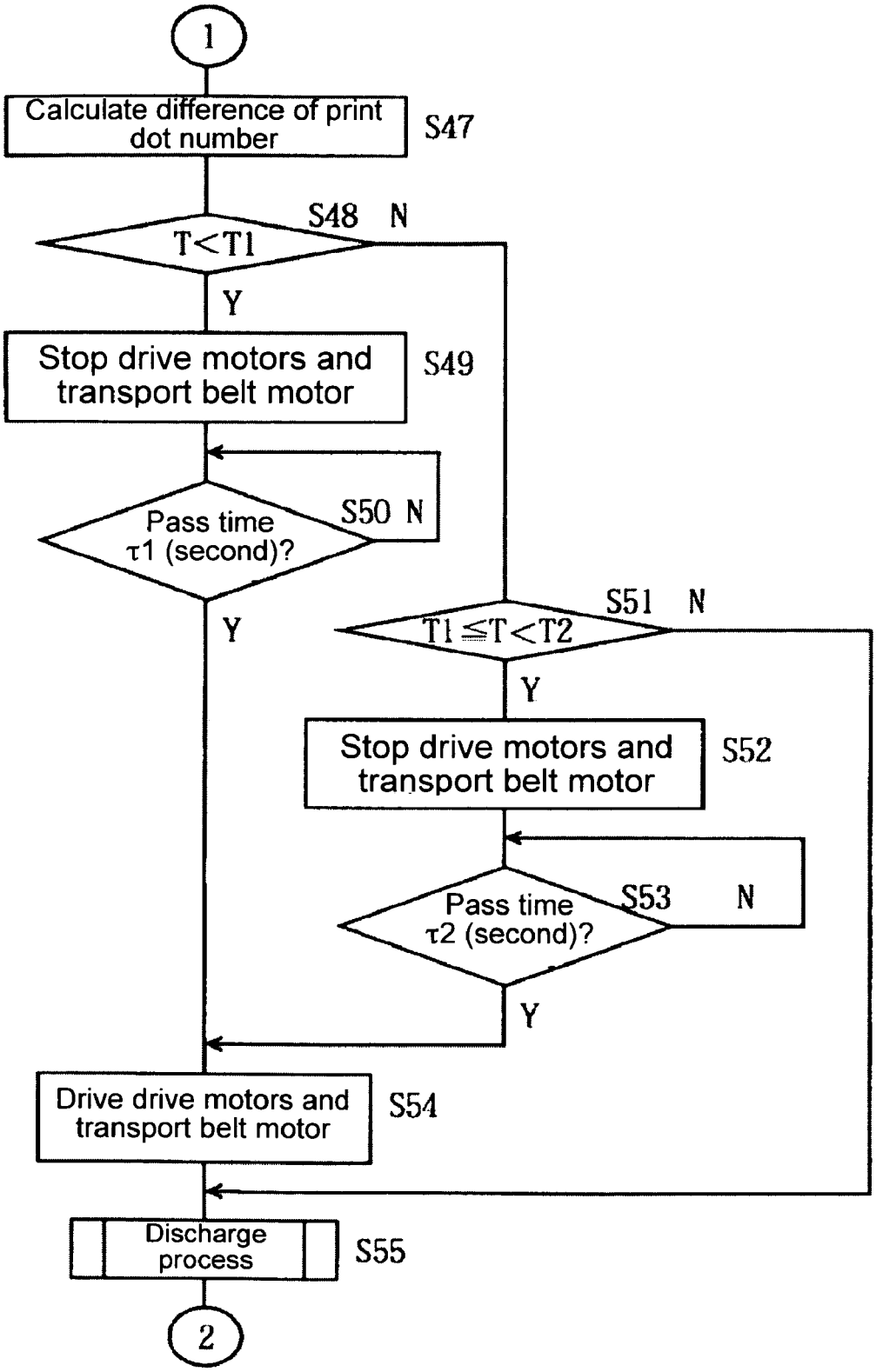
FIG. 13 is a flow chart No. 2 showing the operation of the deteriorated developer discharge process unit of the printer according to the third embodiment of the present invention.

FIG. 12 is a flow chart No. 1 showing an operation of the deteriorated developer discharge process unit of the printer 11 according to a third embodiment of the present invention. FIG. 13 is a flow chart No. 2 showing the operation of the deteriorated developer discharge process unit of the printer 11 according to the third embodiment of the present invention.

In the embodiment, an environmental parameter obtaining process unit of the deteriorated developer discharge process unit performs an environmental parameter obtaining process. More specifically, first, the environmental parameter obtaining process unit retrieves a temperature T (a detected value) detected with the temperature sensor 39 as the environment parameter detection unit or the temperature detection unit.

In the next step, an environmental condition determining process unit of the deteriorated developer discharge process unit performs an environmental condition determining process. More specifically, the environmental condition determining process unit determines an environmental condition where the printer 11 is placed according to the temperature T, and adjusts stop timings of or timings of stopping the control sections 70Bk, 70Y, 70M, and 70C and the transport belt motor 80 according to the temperature T.

In the environmental condition determining process, the environmental condition determining process unit determines whether the temperature T is lower than a first threshold value T1. When the temperature T is lower than the first threshold value T1, the drive termination process unit stops the drive motors 77Bk, 77Y, 77M, and 77C, and the transport belt motor 80 for a specific period of time, i.e., a period of time τ1 (second) in the embodiment, thereby stopping the photosensitive drums 13Bk, 13Y, 13M, and 13C as the photosensitive members, and the transport belt 21.

When the temperature T is higher than the first threshold value T1, the environmental condition determining process unit determines whether the temperature T is lower than a second threshold value T2 (>T1). When the temperature T is lower than the second threshold value T2, the drive termination process unit stops the drive motors 77Bk, 77Y, 77M, and 77C, and the transport belt motor 80 for a specific period of time, i.e., a period of time τ2 (<τ1) (second) in the embodiment, thereby stopping the photosensitive drums 13Bk, 13Y, 13M, and 13C, and the transport belt 21. When the temperature T is higher than the second threshold value T2, the drive termination process unit does not stop the drive motors 77Bk, 77Y, 77M, and 77C, and the transport belt motor 80. Alternatively, when the temperature T is higher than the second threshold value T2, the drive termination process unit may stop the drive motors 77Bk, 77Y, 77M, and 77C, and the transport belt motor 80 for a specific period of time shorter than the period of time T2.

In the embodiment, for example, the first threshold value T1 is set to 150° C.; the second threshold value T2 is set to 27° C.; the period of time T1 is set to 2 (seconds); and the period of time τ2 is set to 0.5 (second). The values are stored in the storage unit of the print control unit 61.

As described above, in the embodiment, when the temperature T is low, the drive termination process unit stops the drive motors 77Bk, 77Y, 77M, and 77C, and the transport belt motor 80. Accordingly, it is possible to stop the photosensitive drums 13Bk, 13Y, 13M, and 13C as the photosensitive members, and the transport belt 21 for a long period of time. As a result, it is possible to securely remove a foreign object accumulated at the abutting portion between the transport belt 21 and the transport belt blade 34, or at the abutting portion between the photosensitive drums 13Bk, 13Y, 13M, and 13C and the cleaning blades 36Bk, 36Y, 36M, and 36C.

In the embodiment, in the continuous printing operation, when deteriorated toner is discharged, it is possible to scrape off deteriorated toner on the transport belt 21 with the transport belt blade 34, or deteriorated toner on the photosensitive drums 13Bk, 13Y, 13M, and 13C with the cleaning blades 36Bk, 36Y, 36M, and 36C, thereby preventing a problem in cleaning. Further, when the temperature T is higher than the second threshold value T2, and a problem in cleaning is not likely occur, the drive termination process unit does not stop the drive motors 77Bk, 77Y, 77M, and 77C, and the transport belt motor 80, thereby increasing through-put of the printer 11.

The flow charts shown in FIGS. 12 and 13 will be explained next. In step S41, the drive motors 77Bk, 77Y, 77M, and 77C and the transport belt motor 80 are driven. In step S42, the process waits for the photosensitive drums 13Bk, 13Y, 13M, and 13C to rotate. When the photosensitive drums 13Bk, 13Y, 13M, and 13C start rotating, the process proceeds to step S43. In step S43, the photosensitive drum rotation number counter 61*c* counts the rotation number p of the photosensitive drum 13Bk. In step S44, the print dot counter 61*d* counts the print dot number d.

In step S45, it is determined whether the rotation number p of the photosensitive drum 13Bk is less than the threshold value Cp. When the rotation number p is greater than the threshold value Cp, the process proceeds to step S46. When the rotation number p is smaller than the threshold value Cp, the process returns to step S42.

In step S46, it is determined whether the print dot number d is less than the threshold value Cd. When the print dot number d is smaller than the threshold value Cd, the process proceeds to step S47. When the print dot number d is greater than the threshold value Cd, the process proceeds to step S56.

In step S47, the difference Δd of the print dot number d is calculated. In step S48, it is determined whether the temperature T is lower than the first threshold value T1. When the temperature T is lower than the first threshold value T1, the process proceeds to step S49. When the temperature T is higher than the first threshold value T1, the process proceeds to step S51. In step S49, the drive motors 77Bk, 77Y, 77M, and 77C and the transport belt motor 80 are stopped. In step S50, the process waits for the period of time τ1 (second). When the period of time τ1 (second) passes, the process proceeds to step S54.

In step S51, it is determined whether the temperature T is higher than the first threshold value T1 and the temperature T is lower than the second threshold value T2. When the temperature T is higher than the first threshold value T1 and the temperature T is lower than the second threshold value T2, the process proceeds to step S52. When the temperature T is higher than the first threshold value T1 and the temperature T is higher than the second threshold value T2, the process proceeds to step S55.

In step S52, the drive motors 77Bk, 77Y, 77M, and 77C and the transport belt motor 80 are stopped. In step S53, the process waits for the period of time τ2 (second). When the period of time τ2 (second) passes, the process proceeds to step S54. In step S54, the drive motors 77Bk, 77Y, 77M, and 77C and the transport belt motor 80 are driven. In step S55, the discharge process is performed.

In step S56, the rotation number p and the print dot number d are cleared. In step S57, it is determined whether there is the print request. When there is the print request, the process returns to step S42. When there is no print request, the process proceeds to step S58. In step S58, the drive motors 77Bk, 77Y, 77M, and 77C and the transport belt motor 80 are stopped, thereby completing the process.

Fourth Embodiment

A fourth embodiment of the present invention will be explained next. Components in the fourth embodiment similar to those in the first to third embodiments are designated with the same reference numerals, and explanations thereof are omitted. The components in the fourth embodiment similar to those in the first to third embodiments provide effects similar to those in the first to third embodiments.

Figure 14:
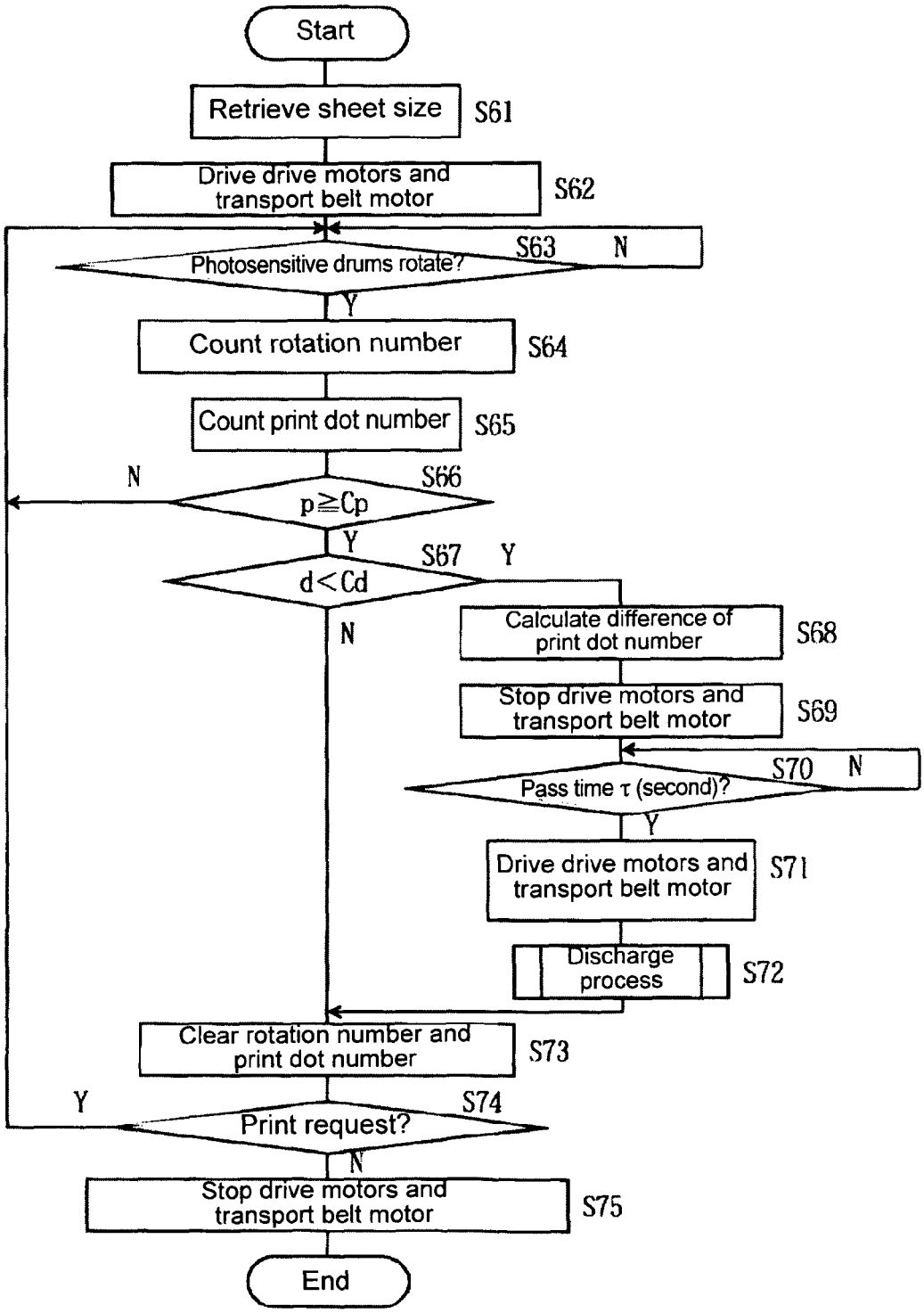
FIG. 14 is a flow chart showing an operation of a deteriorated developer discharge process unit of a printer according to a fourth embodiment of the present invention.
Figure 15:
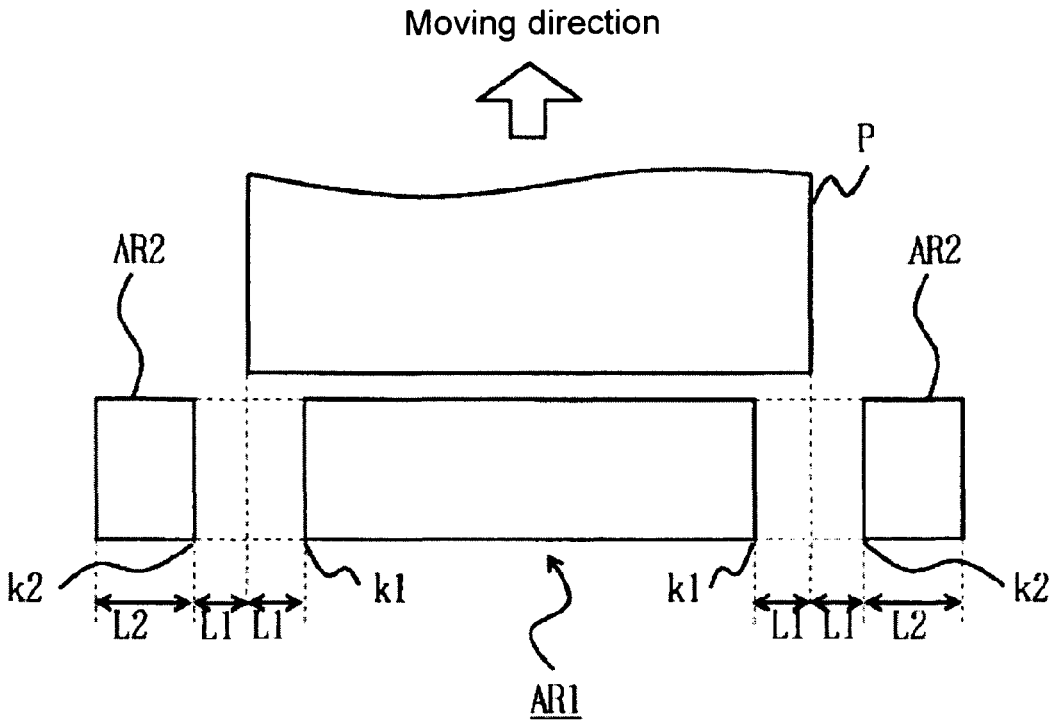
FIG. 15 is a schematic view showing a toner discharge pattern according to the fourth embodiment of the present invention.

FIG. 14 is a flow chart showing an operation of the deteriorated developer discharge process unit of the printer 11 according to the fourth embodiment of the present invention. FIG. 15 is a schematic view showing a toner discharge pattern according to the fourth embodiment of the present invention.

In the embodiment, when the printing operation starts, a medium information obtaining process unit of the deteriorated developer discharge process unit performs a medium information obtaining process. More specifically, the medium information obtaining process unit retrieves a sheet size of the sheet P as the medium set with the host computer (not shown) as the host device, or set by an operator through operating the operation panel 65 (refer to FIG. 3), thereby obtaining medium information.

In the next step, the discharge process unit retrieves a discharge pattern of deteriorated toner according to the sheet size from the storage unit of the print control unit 61.

As shown in FIG. 15, the toner discharge pattern includes an area AR1 situated between lines k1 defined inside from left and right edges of the sheet P by a distance L1, and areas AR2 defined over a distance L2 outside from lines k2 outside from the left and right edges of the sheet P by the distance L1. Accordingly, deteriorated toner is discharged on the areas AR1 and AR2 on the transport belt 21 or the photosensitive drums 13Bk, 13Y, 13M, and 13C.

When the sheet P has the sheet size A4, for example, the distance L1 is set to 15 mm. Accordingly, the toner discharge pattern includes the area AR1 over a width of 180 mm defined between the lines k1 inside from the left and right edges of the sheet P by 15 mm, and the areas AR2 over a length of 30 mm outside from the lines k2 outside from the left and right edges of the sheet P by 15 mm.

In general, paper powder tends to generate from the left and right edges of the sheet P, i.e., cut portions of the sheet P. Accordingly, during the continuous printing operation, paper powder tends to accumulate near the left and right edges of the sheet P at the abutting portion between the transport belt 21 and the transport belt blade 34. In the embodiment, the toner discharge pattern is not formed near the left and right edges of the sheet P. Accordingly, even when paper powder is accumulated near the left and right edges of the sheet P, it is possible to prevent a problem in cleaning.

The flow chart shown in FIG. 14 will be explained next. In step S61, the sheet size is retrieved. In step S62, the drive motors 77Bk, 77Y, 77M, and 77C and the transport belt motor 80 are driven. In step S63, the process waits for the photosensitive drums 13Bk, 13Y, 13M, and 13C to rotate. When the photosensitive drums 13Bk, 13Y, 13M, and 13C start rotating, the process proceeds to step S64. In step S64, the photosensitive drum rotation number counter 61*c* counts the rotation number p of the photosensitive drum 13Bk. In step S65, the print dot counter 61*d* counts the print dot number d.

In step S66, it is determined whether the rotation number p of the photosensitive drum 13Bk is greater than the threshold value Cp. When the rotation number p is greater than the threshold value Cp, the process proceeds to step S67. When the rotation number p is smaller than the threshold value Cp, the process returns to step S63.

In step S67, it is determined whether the print dot number d is less than the threshold value Cd. When the print dot number d is smaller than the threshold value Cd, the process proceeds to step S68. When the print dot number d is greater than the threshold value Cd, the process proceeds to step S73.

In step S68, the difference Δd of the print dot number d is calculated. In step S69, the transport belt 21 is stopped. In step S70, the process waits for the period of time τ (second). When the period of time τ (second) passes, the process proceeds to step S71. In step S71, the drive motors 77Bk, 77Y, 77M, and 77C and the transport belt motor 80 are driven. In step S72, the discharge process is performed.

In step S73, the rotation number p and the print dot number d are cleared. In step S74, it is determined whether there is the print request. When there is the print request, the process returns to step S63. When there is no print request, the process proceeds to step S75. In step S75, the drive motors 77Bk, 77Y, 77M, and 77C and the transport belt motor 80 are stopped, thereby completing the process.

In the embodiment, the distance L1 between the lines k1 and the left and right edges of the sheet P is set equal to the distance L1 between the lines k2 and the left and right edges of the sheet P. Alternatively, the distance L1 between the lines k1 and the left and right edges of the sheet P may be set different from the distance L1 between the lines k2 and the left and right edges of the sheet P.

In the embodiment, the LED heads 15Bk, 15Y, 15M, and 15C are provided as the exposure device of the image forming apparatus. The exposure device may include a laser exposure unit formed of a small laser and a polygon mirror. Further, the printer 11 performs the direct transfer, and may use an intermediate transfer drum or an intermediate transfer belt as an intermediate transfer member disposed between the photosensitive drum and the transfer roller.

In the embodiment, the photosensitive drums 13Bk, 13Y, 13M, and 13C are provided as the photosensitive drum. Alternatively, a photosensitive film may be used. Further, the transport belt 21 is provided as the transfer member, and a transfer roller may be used. Further, the cleaning blades 36Bk, 36Y, 36M, and 36C and the transport belt blade 34 are provided as the removing member. Alternatively, a sponge member, a cleaning roller formed of a sponge, or a cleaning brush having a high brush density may be disposed to abut against the photosensitive drums 13Bk, 13Y, 13M, and 13C and the transport belt 21 for removing toner.

In the embodiments described above, the printer is explained as the image forming apparatus, and the present invention is not limited thereto. The present invention is applicable to a facsimile, a copier, and a multi-function product.

The disclosure of Japanese Patent Application No. 2008-143519, filed on May 30, 2008, is incorporated in the application by reference.

While the invention has been explained with reference to the specific embodiments of the invention, the explanation is illustrative and the invention is limited only by the appended claims.

What is claimed is:

1. An image forming apparatus, comprising:

a developing unit for attaching developer to a static latent image to form a developer image;

an image supporting member for supporting the developer image;

a removing member disposed to abut against the image supporting member for removing the developer;

a drive unit for driving the image supporting member;

a drive control unit for controlling the drive unit, said drive control unit controlling the drive unit to temporarily stop before the developer is discharged;

a print dot number counter for counting a print dot number, said developer being discharged according to the print dot number; and a fixing unit for fixing the developer image to a medium.

2. The image forming apparatus according to claim 1, wherein said image supporting member includes a photosensitive member.

3. The image forming apparatus according to claim 1, wherein said image supporting member includes a transfer member.

4. The image forming apparatus according to claim 1, further comprising a temperature detection unit for detecting an environmental temperature, said drive control unit controlling the drive unit to stop for a period of time according to the environmental temperature.

5. An image forming apparatus, comprising:

a developing unit for attaching developer to a static latent image to form a developer image;

an image supporting member for supporting the developer image;

a transfer member for transporting a medium, said developer image being transferred to the transfer member;

a removing member disposed to abut against the transfer member for removing the developer;

a drive unit for driving the transfer member;

a drive control unit for controlling the drive unit, said drive control unit controlling the drive unit to temporarily stop before the developer is discharged to the transfer member;

a print dot number counter for counting a print dot number, said developer being discharged according to the print dot number; and a fixing unit for fixing the developer image to the medium.

6. The image forming apparatus according to claim 5, further comprising a temperature detection unit for detecting an environmental temperature, said drive control unit controlling the drive unit to stop for a period of time according to the environmental temperature.

7. An image forming apparatus, comprising:

a developing unit for attaching developer to a static latent image to form a developer image;

an image supporting member for supporting the developer image, said image supporting member including a photosensitive member, said photosensitive member including a photosensitive drum;

a removing member disposed to abut against the image supporting member for removing the developer;

a drive unit for driving the image supporting member;

a drive control unit for controlling the drive unit, said drive control unit controlling the drive unit to temporarily stop before the developer is discharged; and a drum counter for counting a rotation number of the photosensitive drum;

a dot number counter for counting a print dot number;

a discharge amount determining process unit for determining a discharge amount of the developer to the photosensitive drum according to the rotation number and the print dot number; and a fixing unit for fixing the developer image to a medium.

8. An image forming apparatus, comprising:

a developing unit for attaching developer to a static latent image to form a developer image;

an image supporting member for supporting the developer image;

a transfer member for transporting a medium, said developer image being transferred to the transfer member, said transfer member including a transport belt;

a removing member disposed to abut against the transfer member for removing the developer;

a drive unit for driving the transfer member;

a drive control unit for controlling the drive unit, said drive control unit controlling the drive unit to temporarily stop before the developer is discharged to the transfer member;

a photosensitive drum for, forming the developer image;

a drum counter for counting a rotation number of the photosensitive drum;

a dot number counter for counting a print dot number;

a discharge amount determining process unit for determining a discharge amount of the developer to the transport belt according to the rotation number and the print dot number; and a fixing unit for fixing the developer image to the medium.

9. An image forming apparatus, comprising:

a developing unit for attaching developer to a static latent image to form a developer image;

an image supporting member for supporting the developer image;

a removing member disposed to abut against the image supporting member for removing the developer;

a drive unit for driving the image supporting member;

a drive control unit for controlling the drive unit;

a fixing unit for fixing the developer image to a medium; and a print control unit for determining whether a condition for discharging the developer is satisfied, wherein said drive control unit is arranged to change a drive speed of the drive unit when the print control unit determines that the condition for discharging the developer that is not used for forming the developer image on the medium is satisfied so that the removing member removes the developer thus discharged afterward.

10. The image forming apparatus according to claim 9, wherein said print control unit is arranged to determine whether the condition for discharging the developer is satisfied during a continuous printing operation, and said drive control unit is arranged to change the drive speed of the drive unit during the continuous printing operation when the print control unit determines that the condition for discharging the developer is satisfied so that the developer thus discharged is removed.

11. The image forming apparatus according to claim 10, wherein said drive control unit is arranged to change the drive speed of the drive unit to zero.

12. The image forming apparatus according to claim 9, wherein said drive control unit is arranged to change the drive speed of the drive unit to zero.

13. The image forming apparatus according to claim 9, wherein said print control unit includes a medium information obtaining process unit for obtaining medium information so that the print control unit determines whether the condition for discharging the developer is satisfied according to the medium information.

14. The image forming apparatus according to claim 9, further comprising a drive measurement unit for measuring a drive amount of the image supporting member, said print control unit being configured to determine whether the condition for discharging the developer that is not used for forming the developer image on the medium is satisfied according to the drive amount measured with the drive measurement unit.

15. The image forming apparatus according to claim 14, wherein said image supporting member includes a photosensitive drum, and said drive measurement unit is formed of a drum counter for counting a rotation number of the photosensitive drum so that the drive amount is the rotation number of the image supporting member.

16. The image forming apparatus according to claim 9, further comprising a measurement unit for measuring a print amount, said print control unit being configured to determine whether the condition for discharging the developer that is not used for forming the developer image on the medium is satisfied according to the print amount measured with the measurement unit.

17. The image forming apparatus according to claim 16, wherein said measurement unit is formed of a dot counter for counting a print dot number so that the print amount is the print dot number.

18. The image forming apparatus according to claim 9, further comprising a drive measurement unit for measuring a drive amount of the image supporting member and a measurement unit for measuring a print amount, said print control unit being configured to determine whether the condition for discharging the developer that is not used for forming the developer image on the medium is satisfied according to the drive amount measured with the drive measurement unit and the print amount measured with the measurement unit.

19. The image forming apparatus according to claim 18, wherein said image supporting member includes a photosensitive drum, said drive measurement unit is formed of a drum counter for counting a rotation number of the photosensitive drum, and said measurement unit is formed of a dot counter for counting a print dot number so that the drive amount is the rotation number of the image supporting member and the print amount is the print dot number.

* * * * *